US006829459B2

(12) United States Patent
Tanaka et al.

(10) Patent No.: US 6,829,459 B2
(45) Date of Patent: Dec. 7, 2004

(54) ELECTROPHOTOGRAPHIC APPARATUS USING PHOTOSENSITIVE MEMBER EMPLOYING CHARGE INJECTION METHOD AND DEVELOPER UNIT CLEANING SYSTEM

(75) Inventors: Daisuke Tanaka, Shizuoka (JP); Yosuke Morikawa, Kanagawa (JP); Kouichi Nakata, Shizuoka (JP); Kimihiro Yoshimura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 10/173,941

(22) Filed: Jun. 19, 2002

(65) Prior Publication Data

US 2003/0099488 A1 May 29, 2003

(30) Foreign Application Priority Data

Jun. 21, 2001 (JP) ..... 2001-188616

(51) Int. Cl.[7] ..... G03G 15/02
(52) U.S. Cl. ..... 399/176; 399/149
(58) Field of Search ..... 399/50, 149, 150, 399/168, 174, 175, 176, 159

(56) References Cited

U.S. PATENT DOCUMENTS 5,809,379 A 9/1998 Yano et al. ..... 399/159
5,835,821 A * 11/1998 Suzuki et al. ..... 399/100
5,933,681 A 8/1999 Suzuki ..... 399/50
5,942,361 A 8/1999 Hoshizaki et al. ..... 430/59
5,970,279 A * 10/1999 Sakaizawa et al. ..... 399/46
6,128,456 A * 10/2000 Chigono et al. ..... 399/176
6,519,433 B1 * 2/2003 Hirabayashi et al. ..... 399/174
6,541,172 B2 * 4/2003 Nagasaka et al. ..... 430/59.5

FOREIGN PATENT DOCUMENTS

JP 05297672 A * 11/1993 ..... G03G/15/00
JP 6-3921 1/1994
JP 7-99442 4/1995
JP 11305521 A * 11/1999 ..... G03G/15/02
JP 2000056543 A * 2/2000 ..... G03G/15/02

* cited by examiner

*Primary Examiner*—Robert Beatty
(74) *Attorney, Agent, or Firm*—Fitzpatrick, Cella, Harper & Scinto

(57) ABSTRACT

An electrophotographic apparatus and a process cartridge have a charge unit for charging the surface of a photosensitive member by direct injection of electrical charge from a contact charging member to the photosensitive member. The charging unit also functions as a unit for supporting residual toner on the surface of the photosensitive member after transfer, for normalizing the electrical charge of the residual toner, and for returning the normalized residual toner to the surface of the photosensitive member. A developing unit also functions as a unit for recovering the normalized residual toner returned to the surface of the photosensitive member. The absolute value of the difference in charged potential between a first rotation and a second rotation of the photosensitive member is higher than 5 V and lower than 70 V. The photosensitive member has a charge injection layer having a specific composition and the charging member supports charged particles having specific characteristics.

40 Claims, 6 Drawing Sheets

ELECTROPHOTOGRAPHIC APPARATUS USING PHOTOSENSITIVE MEMBER EMPLOYING CHARGE INJECTION METHOD AND DEVELOPER UNIT CLEANING SYSTEM

BACKGROUND OF THE INVENTION

1. Field of the Invention

The present invention relates generally to electrophotographic apparatuses, process cartridges, and electrophotographic photosensitive members. Particularly, the present invention relates to an electrophotographic apparatus employing an injection charging method and a toner recycling system and to a process cartridge and an electrophotographic photosensitive member therefor.

2. Description of the Related Art

A typical electrophotographic apparatus comprises an electrophotographic photosensitive member, a charging unit for charging the surface of the electrophotographic photosensitive member, an exposing unit for exposing the charged surface of the electrophotographic photosensitive member so as to form an electrostatic latent image, a developing unit for developing the electrostatic latent image using a toner so as to form a toner image, a transferring unit for transferring the toner image onto a recording medium such as paper, and a fixing unit for fixing the toner image on the recording medium.

A corona discharger has been commonly used as the charging unit. A contact discharging unit that charges the electrophotographic photosensitive member by putting a charging member having a voltage applied thereto into contact with the electrophotographic photosensitive member is also available. Compared with the corona discharger, the contact discharging unit has advantages of low ozone emission and low power consumption.

In a typical contact charging unit, a conductive charging member is placed in contact with an electrophotographic photosensitive member, and a predetermined charging bias is applied to the charging member, hereinafter referred to as the contact charging member, so as to charge the surface of the electrophotographic photosensitive member with a predetermined polarity and potential. Examples of contact charging members include rollers, fur brushes, magnetic blushes, and blades.

The contact charging unit includes two types of charging mechanisms, namely, a discharge charging mechanism and a direct-injection charging mechanism.

The discharge charging mechanism charges the surface of the electrophotographic photosensitive member by a discharge occurring in a minute gap between the contact charging member and the electrophotographic photosensitive member.

In discharge charging, application of a voltage higher than a charge potential to the contact charging member is necessary since the contact charging member and the electrophotographic photosensitive member have a particular discharge threshold value. Moreover, discharge charging inevitably generates discharge products, although the amount of the discharge products is significantly less than that of corona dischargers, and thus adverse effects caused by activated ions, such as ozone, cannot be completely avoided.

The direct-injection charging mechanism has been suggested in Japanese Patent Laid-Open No. 6-3921, for example. In the direct-injection charging mechanism, electrical charges are directly injected into the electrophotographic photosensitive member from the contact charging member to charge the surface of the electrophotographic photosensitive member. More particularly, a voltage is applied to the contact charging member so as to inject electrical charge into a charge sustaining section, such as the trap level, on the surface of the electrophotographic photosensitive member or conductive particles in charge injection layers and to charge the surface of the electrophotographic photosensitive member.

In a charging unit comprising a direct-injection charging mechanism, hereinafter referred to as a "direct-injection charging unit", a contact charging member is put into contact with the surface of the electrophotographic photosensitive member so as to directly inject electrical charges into the surface of the electrophotographic photosensitive member without utilizing a discharge phenomenon, i.e., essentially without requiring a discharge mechanism.

Accordingly, the direct-injection charging unit can charge the electrophotographic photosensitive member at an electrical potential corresponding to the voltage applied to the contact charging member even if the voltage applied to the contact charging member is below the discharge threshold value. In other words, since the discharge phenomenon is not dominant, the voltage for charging applied to the contact charging member need only have the charge potential desired at the surface of the electrophotographic photosensitive member.

Moreover, the direct-injection charging unit does not generate activated ions and is thus free from the problems caused by the discharge products, such as ozone.

A charging brush or a charging magnetic brush is expensive for use as the contact charging member. In a contact charging member comprising a magnetic brush, charged carriers often leak from a charging sleeve during an electrophotographic process. A roller, hereinafter referred to as a "charging roller", is preferably used as the contact charging member.

However, direct-injection charging is difficult with a simple structure using a charging roller or a brush, and may result in the fogging of images, i.e., development of a blank background in reversal development, and nonuniform charging.

In view of the above problems, the following direct-injection charging unit has been suggested.

The suggested direct-injection charging unit comprises a contact charging member including charged particles, which come into contact with an electrophotographic photosensitive member, and a charged particle support for supporting the charged particles. The charged particle support has a conductive and elastic surface. With this direct-injection charging unit, sufficient contact and uniform charging are possible during direct-injection charging.

An electrophotographic apparatus comprising the above direct-injection charging unit may be of a toner recycle type. In such an electrophotographic apparatus, the charging unit also functions as means for supporting residual toner on the surface of the electrophotographic photosensitive member after transfer by a transfer unit so as to normalize the charge of the residual toner (primary recovering), and for returning the normalized toner onto the surface of the electrophotographic photosensitive member. The developing unit also functions as means for recovering the normalized residual toner returned onto the surface of the electrophotographic photoresistor by the charging unit.

Japanese Patent Publication No. 7-99442 discloses a contact charging apparatus in which a powder is applied on the face of a charging member that comes into contact with the surface of an electrophotographic photosensitive member so as to uniformly charge the contact charging apparatus. Although ozone products are reduced compared to a corona charger such as scorotron, charging is based on corona charging caused by discharging. Moreover, a direct current voltage superimposed by an alternating current voltage is applied to more reliably achieve uniformity in charging. Thus, the amount of the discharge products is still large.

However, an electrophotographic apparatus comprising a direct-injection charging unit as means for charging an electrophotographic photosensitive member and employing a toner recycling system suffers from the following problem. In the recycle system, toner recovered by the charging unit during primary recovering has an electrical potential of the same polarity as that of the voltage applied to the charging unit. The toner is returned to the surface of the electrophotographic photosensitive member by the potential difference relative to the surface of the electrophotographic photosensitive member. In such a system, an excessive amount of toner may be stored-in the charging unit after several uses depending on the performance of recycling, thereby damaging the electrophotographic photosensitive member. Even if the performance of toner recycle is satisfactory, imaging failure such as ghost may occur from an early stage.

SUMMARY OF THE INVENTION

The inventors have found through extensive research that both improved efficiency in toner recycling and prevention of ghosting can be achieved by adjusting the difference in charged potential between a first rotation and a second rotation of the electrophotographic photosensitive member of the electrophotographic apparatus in a predetermined range.

The recovery of the residual toner is done by a charging unit (primary recovery) and by a developing unit because of the difference between the surface potential of the electrophotographic photosensitive member and the voltage applied to the charging unit and the developing unit.

Accordingly, if the difference in the charged potential between the first rotation and the second rotation of the electrophotographic photosensitive member is excessively small, the difference in the potential between the surface of the electrophotographic photosensitive member and the charging unit also becomes small. As a result, the residual toner cannot be properly ejected onto the surface of the electrophotographic photosensitive member from the charging unit. The residual toner accumulates at the contact charging member of the charging unit, causing contamination of the charging unit. Contamination of the charging unit causes imaging failure and damages the surface of the electrophotographic photosensitive member.

When the difference in charged potential is excessively large, if the unit is used in a reversal development process in which a dark potential section is undeveloped and a light potential section is developed, the section illuminated during a previous printing operation remains. When a full-page black image or a halftone image is subsequently processed, the section illuminated during the last printing appears dark or comes off blank. In other words, a ghost may be generated.

The present invention is made based on the knowledge described above.

An aspect of the present invention provides an electrophotographic apparatus including a toner recycling system, the apparatus including:

an electrophotographic photosensitive member including a support and a photosensitive layer on the support;

a charging means for charging the surface of the electrophotographic photosensitive member;

an exposing unit for exposing the charged surface of the electrophotographic photosensitive member to form an electrostatic latent image;

a developing unit for developing the electrostatic latent image with toner so as to form a toner image;

a transferring unit for transferring the toner image onto a recording medium; and a fixing unit for fixing the toner image on the recording medium, the charging unit including a contact charging member that comes into contact with the surface of the electrophotographic photosensitive member, the surface of the electrophotographic photosensitive member being charged by the direct injection of electrical charge from the contact charging member to the electrophotographic photosensitive member, the contact charging member including charged particles that come into contact with the electrophotographic photosensitive member and a charged particle support for supporting the charged particles, the surface of the charged particle support being conductive and elastic, the charging unit also functioning as a unit for supporting the residual toner on the surface of the electrophotographic photosensitive member after transfer, for normalizing the electrical charge of the residual toner, and for returning the residual toner onto the surface of the electrophotographic photosensitive member, the developing unit also functioning as a unit for recovering the normalized toner returned onto the surface of the electrophotographic photosensitive member, wherein the absolute value of the charge potential difference between a first rotation and a second rotation of the electrophotographic photosensitive member is higher than 5 V and lower than 70 V.

Another aspect of the present invention provides a process cartridge which is detachably attachable to a main body of an electrophotographic apparatus, the process cartridge including:

an electrophotographic photosensitive member including a support and a photosensitive layer;

a charging unit for charging the surface of the electrophotographic photosensitive member;

a developing unit for developing an electrostatic latent image with toner so as to form a toner image, the electrostatic latent image being formed on the charged surface of the electrophotographic photosensitive member by using an exposing unit of the electrophotographic apparatus;

a transferring unit for transferring the toner image onto a recording medium; and a fixing unit for fixing the toner image on the recording medium, the charging unit including a contact charging member that comes into contact with the surface of the electrophotographic photosensitive member, the surface of the electrophotographic photosensitive member being charged by direct injection of electrical charge from the contact charging member to the electrophotographic photosensitive member, the contact charging member including charged particles that come into contact with the electrophotographic photosensitive member and a charged particle support for supporting the charged particles, the surface of the charged particle support being conductive and elastic, the charging unit also functioning as a unit for supporting the residual toner on the surface of the electrophotographic photosensitive member after the toner image formed on the surface of the electrophotographic photosensitive member by using the developing unit is transferred onto the recording medium through the transferring unit, for normalizing the electrical charge of the residual toner, and for returning the residual toner onto the surface of the electrophotographic photosensitive member, the developing unit also functioning as a unit for recovering the normalized toner returned onto the surface of the electrophotographic photosensitive member, wherein the absolute value of the charge potential difference between a first rotation and a second rotation of the electrophotographic photosensitive member, is higher than 5 V and lower than 70 V.

Further objects, features and advantages of the present invention will become apparent from the following description of the preferred embodiments with reference to the attached drawings.

DESCRIPTION OF THE PREFERRED EMBODIMENTS

In the present invention, the absolute value of the difference in charged potentials, hereinafter also referred to as the "charged potential difference", between a first rotation and a second rotation refers to the absolute value of the difference between the charged potential produced by rotating a stationary electrophotographic photosensitive member once, and the charged potential produced after the second rotation which begins at the end of the first rotation. The charged potential is affected by the electrophotographic photosensitive member and various conditions of the charging unit such as the magnitude of the applied voltage, the type of charged particles, and the size of a nip section formed by the charging unit and the photosensitive member. Thus, the conditions of the charging unit must be the same as those of the charging unit actually used in the electrophotographic apparatus for forming images during measurement of the charged potential.

The absolute value of the difference in charged potential (charged potential difference) between the first rotation and the second rotation of the electrophotographic photosensitive member must be more than 5 V and less than 70 V, and more preferably, more than 20 V and less than 70 V.

First, the structure of the electrophotographic apparatus of the present invention is explained.

Figure 1:
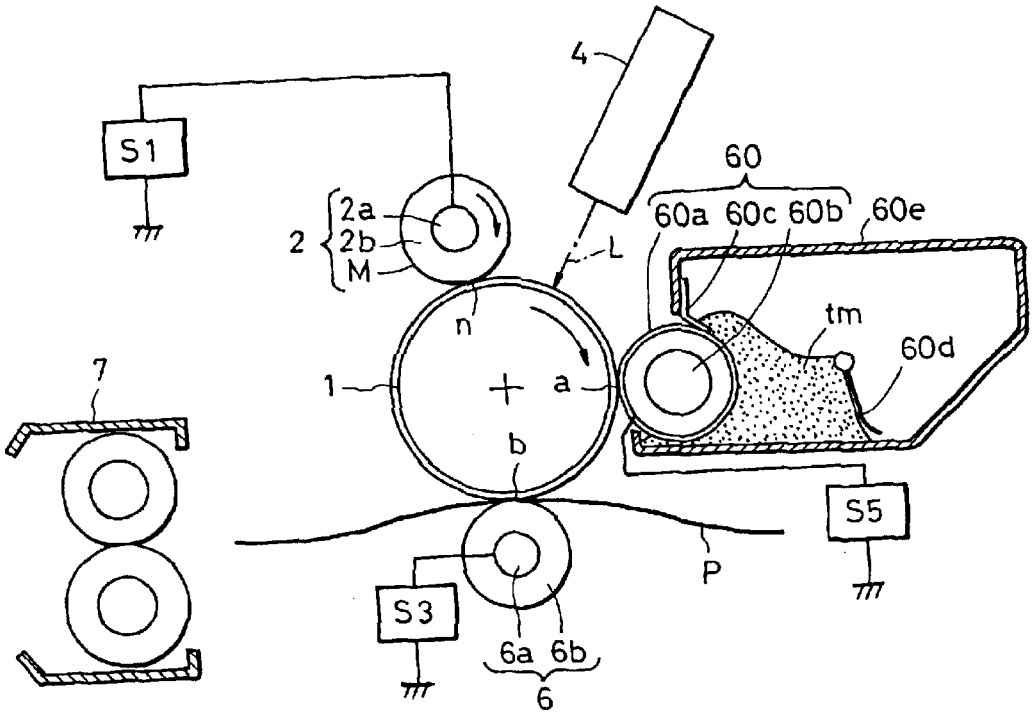
FIG. 1 is a schematic view showing an overview of the structure of an electrophotographic apparatus according to an embodiment of the present invention.

The electrophotographic apparatus of the present invention is of a transfer type and employs a toner recycling process of a direct-injection charging method. FIG. 1 shows an embodiment of an electrophotographic apparatus of the present invention. The structure of the electrophotographic apparatus of the present invention is by no means limited by this embodiment.

Referring to FIG. 1, the electrophotographic apparatus of the present invention comprises an electrophotographic photosensitive member 1. The electrophotographic photosensitive member 1 is driven to rotate in the direction of the arrow in the drawing at a predetermined peripheral speed, i.e., a process speed PS or a printing speed.

A charging unit 2 comprises conductive particles (charged particles) M and a charged particle support having an intermediate resistance layer (elastic layer) 2*b* and a core bar 2*a*. The charging unit 2 abuts the electrophotographic photosensitive member 1 to produce a predetermined deformation amount so as to form a charge contact region n.

The charged particle support is driven to counter-rotate relative to the rotation direction of the electrophotographic photosensitive member 1 at this charge contact region n and comes into contact with the surface of the electrophotographic photosensitive member 1 at a different speed from the speed of the rotation of the electrophotographic photosensitive member 1.

During formation of images, a predetermined charging bias is applied from a power supply S1 to the charging unit 2 so as to uniformly charge the peripheral surface of the electrophotographic photosensitive member 1 to a predetermined polarity and potential through direct-injection charging.

The charged particles M and a toner t are stored in a development container 60*e* of a developing unit 60 described below. The charged particles M are supplied to a charging roller through the electrophotographic photosensitive member 1 during development with the toner t. The electrophotographic apparatus may further comprise a charged particle supplier for supplying the charged particles M to the charged particle support.

The electrophotographic apparatus further includes an exposing unit 4. A laser beam scanner having a laser diode, a polygon mirror, and the like, may be used as the exposing unit 4, for example. The laser beam scanner outputs a laser beam L having a modified intensity corresponding to a time-series digital image signal of target image data. The laser beam L scans and develops the uniformly charged surface of the above-described rotating electrophotographic photosensitive member 1 so as to form an electrostatic latent image corresponding to the target image data on the surface of the electrophotographic photosensitive member 1.

The resulting electrostatic latent image on the surface of the rotating electrophotographic photosensitive member 1 is developed to form a toner image at a developing region a through a developing unit 60. The development container 60*e* of the developing unit 60 contains a mixture tm comprising the toner t and the charged particles M. The developing unit 60 has a nonmagnetic rotatable development sleeve 60*a* including a magnet roll 60*b*. The nonmagnetic rotatable development sleeve 60*a* supports and transfers the developer. The toner t in the mixture tm before development, contained in the development container 60*e*, is charged and the thickness of the layer of the toner t is regulated by a regulating blade 60*c* as the toner t over is transferred through the nonmagnetic rotatable development sleeve 60*a*. The development container 60*e* includes a mixing member 60*d* to allow the toner t in the development container 60*e* to circulate and to sequentially transfer the toner to the vicinity of the nonmagnetic rotatable development sleeve 60*a*.

The electrostatic latent image on the electrophotographic photosensitive member is developed at the developing region a by the bias applied between the regulating blade 60*c* and the electrophotographic photosensitive member 1.

The electrophotographic apparatus further includes a transferring unit 6. The transferring unit 6 is made by forming an intermediate resistance foam layer 6*b* around a core bar 6*a*. A voltage is applied to the core bar 6*a* to perform transfer.

The electrophotographic apparatus of the present invention employs a toner recycling process. The residual toner on the surface of the electrophotographic photosensitive member 1 after image transfer is temporarily recovered by the charging unit 2 counter-rotating relative to the rotation of the electrophotographic photosensitive member 1. The reversed toner potential is normalized as the recovered toner rotates along the outer periphery of the charging unit 2. The recovered toner is sequentially discharged onto the electrophotographic photosensitive member 1 and reaches the developing region a. The discharged toner is recovered and recycled by simultaneous developing and cleaning in the developing unit 60. No dedicated cleaning unit is necessary to remove the residual toner.

The electrophotographic apparatus also includes a fixing unit 7. Thermal fixing, for example, may be suitably employed in the fixing unit 7. A recording medium P is fed to a transfer nip region b between the electrophotographic photosensitive member 1 and the transferring unit 6, and a toner image on the electrophotographic photosensitive member 1 is transferred onto the recording medium P. The recording medium P is then detached from the surface of the rotating electrophotographic photosensitive member 1 to be fed to the fixing unit 7 where the toner image is affixed. The recording medium P is then discharged as a print copy.

Figure 6:
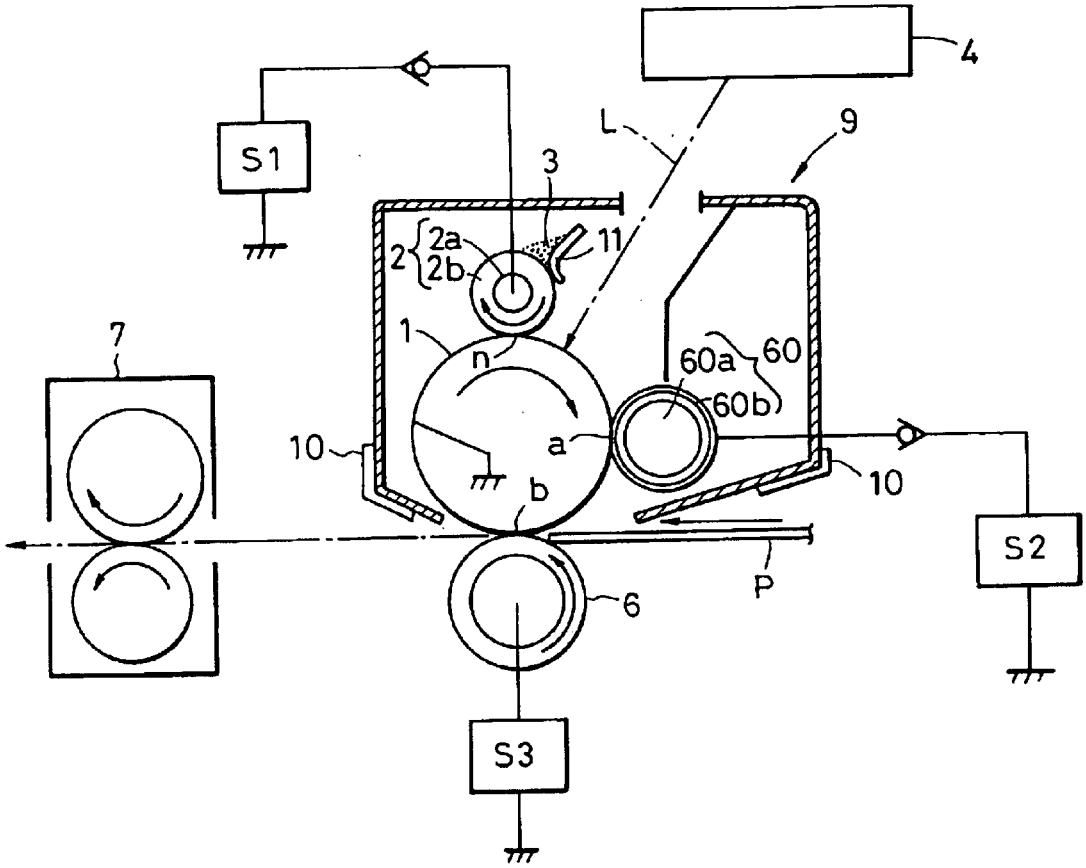
FIG. 6 is a schematic view showing an overview of the structure of a process cartridge having the electrophotographic photosensitive member of the present invention.

Alternatively, as shown in FIG. 6, where the same reference characters denote identical elements, the charging unit 2, the developing unit 60, and the electrophotographic photosensitive member 1 may be integrally accommodated in one cartridge, i.e., a process cartridge 9. The process cartridge 9 may be detachably attached to a guide unit such as a rail 10 of the apparatus body. A regulating blade 11 may be provided in the process cartridge 9, as shown in FIG. 6

In FIGS. 1, 2, 5 and 6, symbols S1 to S5 represent power supplies. In the drawings, the same reference numerals are used to represent the same components and the descriptions thereof are omitted to avoid redundancy.

Figure 5:
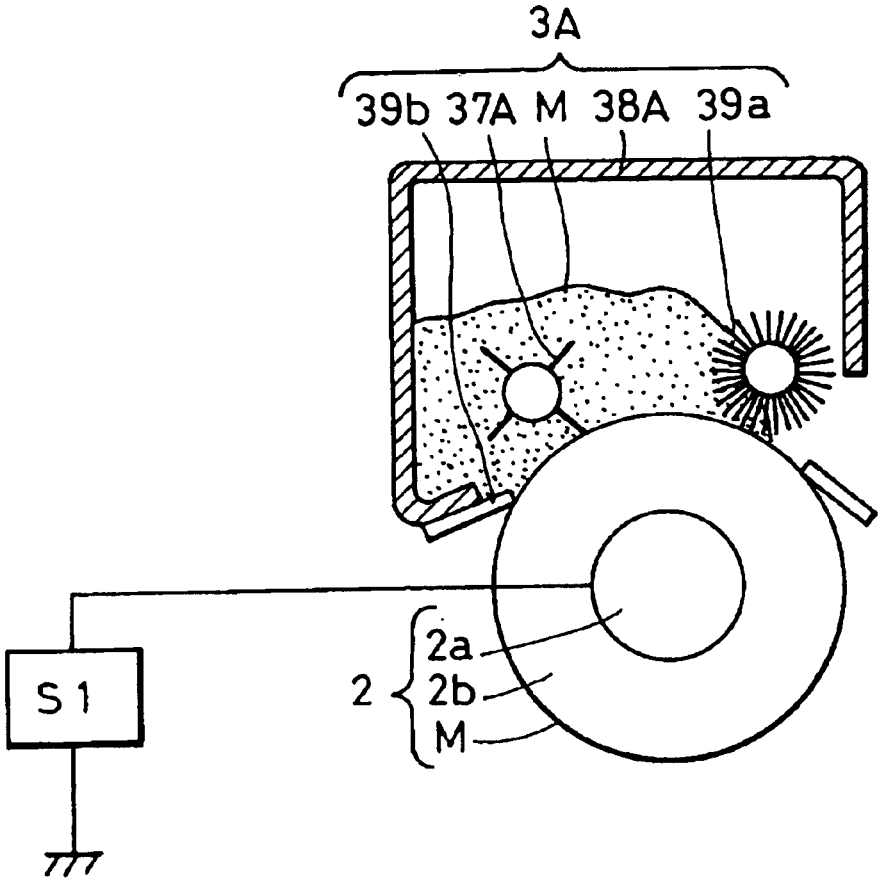
FIG. 5 is a schematic view showing an overview of the structure of a charged particles supplier of the electrophotographic apparatus of the present invention.

FIG. 5 is a diagram showing an overview of the structure of a charged particle supplier 3A of the electrophotographic apparatus of the present invention. The charged particle supplier 3A comprises charged particles M, mixing blades 37A, a housing 38A, a fur brush 39*a*, and a regulating blade 39*b*.

The structure of the charging unit 2 and the developing unit 60 of the photosensitive member apparatus of the invention will now be described.

The charged particle support of the charging unit used in the electrophotographic apparatus of the present invention is preferably a roller (charging roller) comprising the core bar 2*a* and the intermediate resistance layer (elastic layer) 2*b* made of rubber or foam formed on the core bar 2*a*.

The intermediate resistance layer (elastic layer) 2*b* is formed on the core bar 2*a* using a sulfurizing agent, a foaming agent, and a resin such as a urethane, so as to form a roller. The surface of the intermediate resistance layer (elastic layer) 2*b* may be polished to yield a predetermined surface roughness.

The surface of the charged particle support must have a certain surface roughness so as to densely support the charged particles. The average roughness Ra is preferably in the range of 1 $\mu$m to 500 $\mu$m. At Ra of less than 1 $\mu$m, the surface area which supports the charged particles is not sufficient. When insulating matter such as toner adheres onto the surface of the charged particle support, the charged particles supported at the adhered portion cannot be put into contact with the electrophotographic photosensitive member, thereby degrading charging performance. At Ra exceeding 500 $\mu$m, irregularity of the roller surface degrades planar charging uniformity of the electrophotographic photosensitive member.

The average roughness Ra is measured using surface-shape measurement microscopes VF-7500 and VF-7510, available from Keyence Co., Ltd, with an object lens of 1250 to 2500 magnification. The shape of the roller surface and Ra are examined by noncontact measurement.

In direct injection charging, a breakdown voltage does not accompany charging and charging can be performed at a low voltage. Thus, the charging roller, i.e., the charged particle support, does not necessarily have high resistance and can be made as a single layer.

The surface resistance of the charged particle support is preferably in the range of $10^4$ to $10^{10}$ Ω. A surface resistance exceeding $10^{10}$ Ω degrades planar charging uniformity and causes irregular stripes to appear in halftone images due to friction with the roller, thereby degrading image quality. A surface resistance less than $10^4$ Ω would decrease the voltage in the vicinity of drum pin holes.

The volume resistivity of the charged particle support is preferably in the range of $10^4$ to $10^7$ Ω·cm. A volume resistivity less than $10^4$ Ω·cm would decrease the voltage of the power supply due to pin hole leakage. A volume resistivity exceeding $10^7$ Ω·cm would decrease the charge voltage since the current necessary for charging cannot be secured.

Figure 2A:
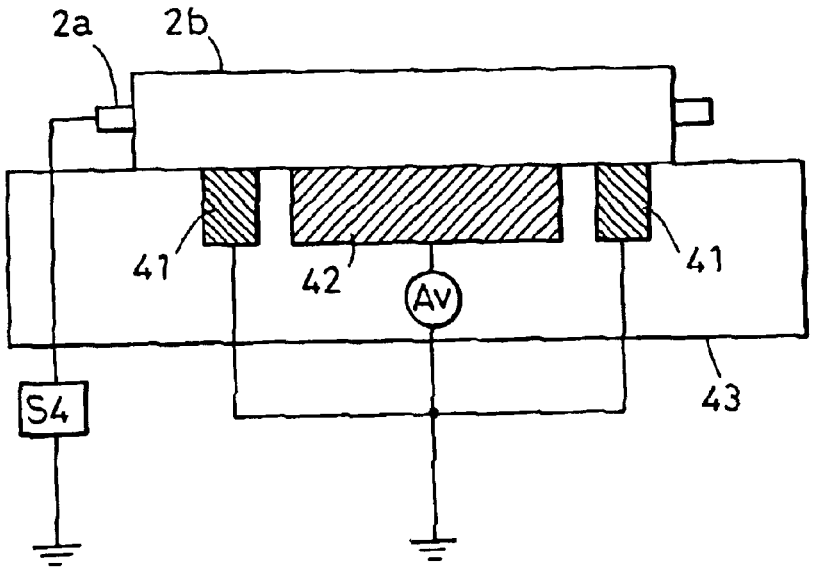
FIG. 2A is a schematic view showing a method for measuring the volume resistance of an elastic charging member.
Figure 2B:
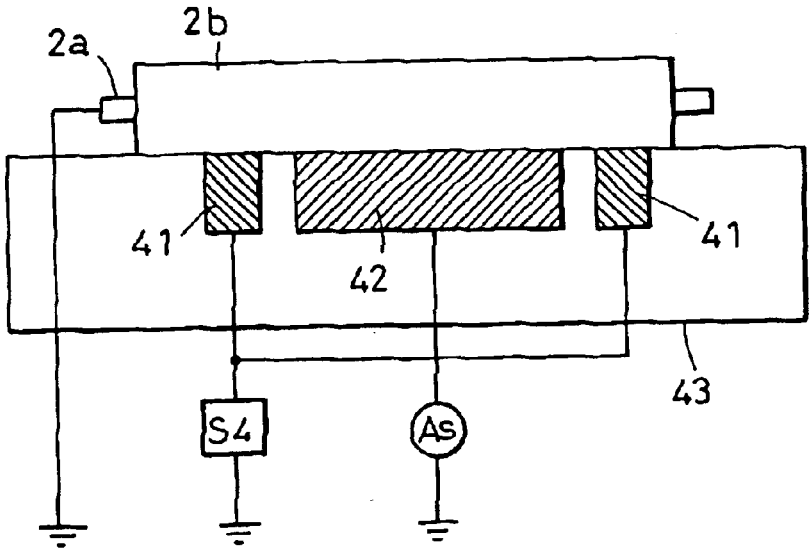
FIG. 2B is a schematic view showing a method for measuring the surface resistance of the elastic charging member.

The resistance of the charged particle support is measured as follows. FIGS. 2A and 2B are schematic diagrams showing the structure of the charged particle support during measurement.

The resistance of the charged particle support is measured by attaching electrodes to an insulator drum 43 having an external diameter of 30 mm so that a total load of 1 kg is applied on the core bar 2*a* of the charged particle support. The electrodes are arranged such that guard electrodes 41 are arranged around a main electrode 42 with interconnections as shown in FIG. 2. The distance between the main electrode 42 and each of the guard electrodes 41 is adjusted to be substantially the same as the thickness of the intermediate resistance layer (elastic layer) 2*b*. The main electrode 42 has a sufficient width relative to the guard electrodes 41. The volume resistivity and the surface resistance are measured by applying a voltage of +100 V to the main electrode 42 from the power supply S4 and measuring the electric current flowing in ampere meters Av and As.

In direct injection charging, it is important that the charging unit function as an elastic electrode. In the charging unit of the photosensitive member apparatus of the present invention, the elasticity of the intermediate resistance layer (elastic layer) 2*b* of the charged particle support can be adjusted to form an elastic electrode, for example. The intermediate resistance layer (elastic layer) 2*b* preferably has an Asker C hardness in the range of 15 to 50 degrees, and more preferably, 25 to 40 degrees. At an excessively high hardness, a sufficient deformation amount cannot be obtained, and charge performance may be degraded since the charge contact region n cannot be sufficiently formed between the electrophotographic photosensitive member and the charged particle support. Moreover, substances therein do not come into contact with one another at the molecular level, and thus contamination by foreign matter readily causes contact failure at the contaminated area. At an excessively low hardness, the shape becomes unstable resulting in an uneven contact pressure relative to the object to be charged and eventually in nonuniform charging. Furthermore, the roller may suffer permanent deformation if left to stand for a long period of time, resulting in charge failure.

Examples of materials for the charging roller include ethylene-propylene-diene terpolymer (EPDM), urethanes, acrylonitrile-butadiene rubber (NBR), silicone rubber, and polyisoprene rubber (IR). Conductive substances such as carbon black or metal oxides are dispersed into these rubber materials to adjust the resistance. Alternatively, the resistance may be adjusted without dispersing the conductive materials by using ion-conductive materials. Subsequently, the surface roughness is adjusted and shaping is performed by polishing or the like, as required. The roller may comprise a plurality of layers having separate functions.

Preferably, the roller has a porous structure since the surface roughness can be adjusted at the same time as forming the roller, thereby providing a manufacturing advantage. The cell diameter of the foam body is preferably 1 $\mu$m to 500 $\mu$m.

After forming by foaming, the surface of the formed body is polished to expose a porous surface so as to make a surface structure having the above-described roughness.

The charged particles M are made from conductive particles. Examples of conductive particles include inorganic particles such as an oxide of at least one metal element, a mixture of the inorganic particles and an organic substance, and the surface-treated corresponding particles. The charged particles of the present invention do not have to be magnetic since these particles are not constrained by magnetism.

In the electrophotographic apparatus of the present invention, charging is performed through exchange of charges through the charge particles. Thus, the resistivity of the charged particles is preferably $10^{12}$ Ω·cm or less, and more preferably, $10^{10}$ Ω·cm or less.

The resistance of the charged particles is measured by a tablet method and normalized. That is, 0.5 g of charged particles are placed in a cylinder having a base area of 2.26 $cm^2$, a pressure of 15 kg and a voltage of 100 V are simultaneously applied to upper and lower electrodes to measure the resistance. The results are normalized to calculate the resistance.

The grain diameter of the charged particles is preferably 10 $\mu$m or less so as to achieve a charge efficiency higher than that when charging using a magnetic brush, and uniform charging. In the present invention, when particles form an agglomerate, the grain diameter is defined as the average diameter of the agglomerate.

In measuring the grain diameter, 100 or more particles are selected from observation using an electron microscope. Maximum horizontal chord length is measured to calculate the volume grain diameter distribution so as to determine the 50% average grain diameter.

The charged particles may exist as primary particles or secondary particles in agglomerates. The state of agglomeration is not important as long as the particles function as charged particles.

Since the charged particles are used in charging the electrophotographic photosensitive member, the charged particles are preferably substantially white or transparent so as not to obstruct development of the latent image. Since some of the charged particles are transferred onto the recording medium P from the photosensitive member, the charged particles are preferably colorless or white in color printing. The grain diameter is preferably less than the size of configuration pixels, and more preferably, less than the grain diameter of the toner. The lower limit of the grain diameter is 10 nm in view of particle stability. The charged particles are preferably positively charged.

The developing unit employed in the electrophotographic apparatus of the present invention is preferably a reversal development unit using a monocomponent magnetic toner (negative toner). With a bicomponent toner, magnetic carriers may spill onto the electrophotographic photosensitive member along with toner and may damage the surface of the electrophotographic photosensitive member when trapped between the electrophotographic photosensitive member and the charging unit.

Referring to FIG. 1, the developing unit 60 has the nonmagnetic rotatable development sleeve 60*a* including the magnet roll 60*b*. The nonmagnetic rotatable development sleeve 60*a* supports and transfers the toner. The toner t in the mixture tm contained in the development container 60*e* is charged and the thickness of the layer of the toner t is regulated by the regulating blade 60*c* during transfer of the toner t over the nonmagnetic rotatable development sleeve 60*a*. The development container 60*e* includes the mixing member 60*d* to allow the toner t to circulate and to sequentially transfer the toner to the vicinity of the nonmagnetic rotatable development sleeve 60*a*.

The toner t coating the nonmagnetic rotatable development sleeve 60*a* is transferred by the rotation of the nonmagnetic rotatable development sleeve 60*a* into the development section (developing region) a at which the electrophotographic photosensitive member 1 opposes the nonmagnetic rotatable development sleeve 60*a*.

The developing bias voltage is preferably a superimposed voltage of a DC voltage and an AC voltage. The electrostatic latent image on the electrophotographic photosensitive member 1 is thereby reversed and developed by the toner t.

The toner is made by mixing a binder resin, magnetic particles, and a charge control agent to form a mixture, kneading, crushing, and classifying the mixture, and adding external additives such as charged particles M and a plasticizer.

The average grain diameter D4 of the toner is preferably 5 to 10 $\mu$m.

Figure 3:
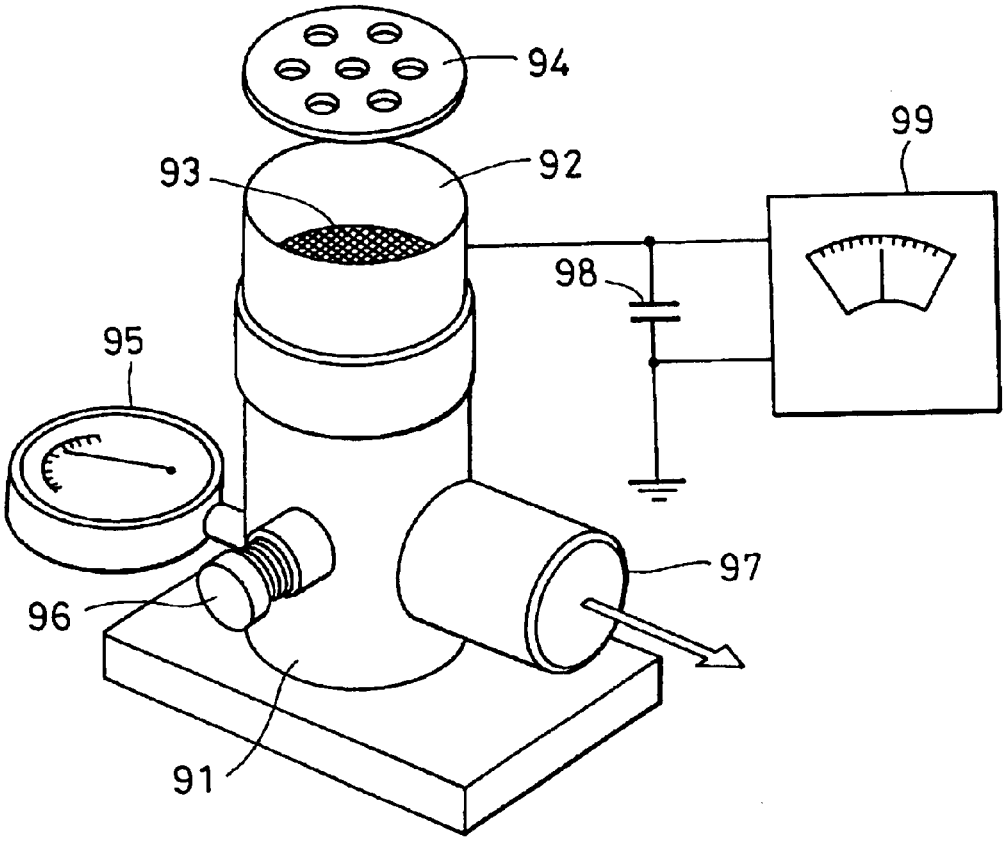
FIG. 3 is a perspective view showing an overview of the structure of an apparatus for measuring the frictional charge of toner particles.

Next, a process for measuring the charge of the toner particles is explained with reference to FIG. 3.

At a temperature of 23° C. and a relative humidity of 60%, a mixture of 19.6 g of iron carrier DSP-138 and 0.4 g of charged particles is placed in a 50 to 100 ml polyethylene jar. The jar is manually shaken 50 times. Next, 1.0 to 1.2 g of the above mixture is placed in a metal measuring container 92 having a 500-mesh screen 93 at the bottom, and a metal lid 94 is placed on the top. The mass $W_1$ (g) of the whole measuring container 92 is measured. Next, in a suction machine 91, which is insulative at least at a portion in contact with the measuring container 92, suction is performed through a suction duct 97 while adjusting an airflow adjustor 96 until a pressure of 4900 hPa is reached at a vacuum meter 95. The toner is then removed by suction for 1 minute. The voltage at an electrometer 99 at this time is defined as the voltage V (volt), and the capacitance at a capacitor 98 is defined as C ($\mu$F). The mass of the whole measuring container 92 is measured after suction and is defined as $W_2$ (g). The frictional charge of the toner ($\mu$C/g) is given by the formula below:

$$\text{Frictional charge } (\mu C/g) = CV/(W_1 - W_2)$$

The electrophotographic apparatus of the present invention employs a toner recycling system. The charging unit may be provided with a charged electrode supplier, but the structure of the charging unit is simpler without a charged electrode supplier. However, in a system in which no charged particle supplier is provided and the charged particles are stored with the toner in the development container of the developing section so as to be supplied onto the charged particle support through the electrophotographic photosensitive member during development of the toner, a considerable amount of toner may contaminate the surface of the charged particle support.

In order to sustain charges provided by frictional charging on the surface, the toner preferably has a resistivity of $10^{13}$ Ω·cm or more.

If the charged particle support is contaminated with toner, the resistivity of the charged particles on the charged particle support increases, thereby degrading the charging performance. Even if the resistivity of the charged particles is low, the resistivity of the particles supported by the charged particle support increases as a whole due to the contaminating toner, thereby degrading the electrostatic property. Thus, the amount of the charged particles that the charged particle support supports is preferably 0.1 to 50 mg/cm$^2$, and more preferably, 0.1 to 10 mg/cm$^2$.

If the toner content is high, the charging characteristics are naturally degraded. In such a case, the resistance of the supported particles as a whole increases. Thus, in practice, the entirety of the particles, including contaminants such as toner and paper dust, supported by the charged particle support is measured to determine the resistance as described above. The resistivity is preferably $10^{-1}$ to $10^{12}$ Ω·cm, and more preferably, $10^{-1}$ to $10^{10}$ Ω·cm.

In order to determine an effective amount of the charged particles during charging, it is important to adjust the ratio of the charged particle support coated by the charged particles, i.e., the coating ratio. Since white charged particles are distinguishable from black magnetic toner, the region that appears white when observed using a microscope is measured to calculate the area ratio. At a coating ratio of less than 0.2, the charging characteristics are insufficient even when the peripheral speed of the charged particle support is increased. Thus, the coating ratio of the charged particles is preferably in the range of 0.2 to 1. Alternatively, a fluorescent X-ray method may be employed to measure the amount of the charged particles; for example, if charged particles containing zinc and toner containing iron are used in combination, the amount of charging particles can be measured by analyzing the amount of zinc in the charged particles and the amount of iron in the toner.

As described above, the charged particles are preferably positively charged. The positively charged particles exist in the dark potential region of the photosensitive region in a larger amount. Ideally, the charged particles transferred to the dark potential region of the photosensitive member remain on the photosensitive member without being transferred onto a recording medium during the transfer step, so that the charged particles are readily fed to the charged particle support.

In view of the above, the absolute value of the difference in charge potential (charge potential difference) between the first rotation and the second rotation of the electrophotographic photosensitive member is adjusted to be larger than 5 V and smaller than 70 V. At such a value, the electrical charge at the dark potential region of the electrophotographic photosensitive member increases, thereby increasing the Coulomb's force working with the charged particles. As a result, the amount of the charged particles transferred from the electrophotographic photosensitive member to the recording medium decreases. The amount of the conductive particles supplied to the charged particle support thereby increases so as to achieve further stable charging.

Next, the structure of the electrophotographic photosensitive member used in the electrophotographic apparatus of the present invention is explained.

The electrophotographic photosensitive member of the present invention may be a single-layer type having a single layer containing a charge generating substance and a charge transporting substance or may be a composite type comprising a charge generating layer containing a charge generating substance and a charge transporting layer containing a charge transporting substance. The composite type is preferred in view of the electrophotographic characteristics.

Figure 4A:
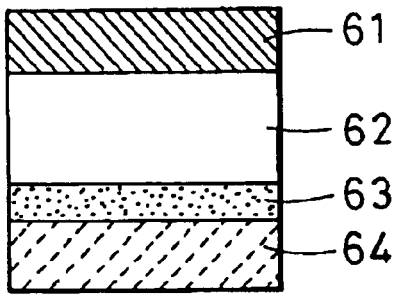
FIGS. 4A to 4C are schematic diagrams showing exemplary layer structures of electrophotographic photosensitive members according to the present invention.
Figure 4B:
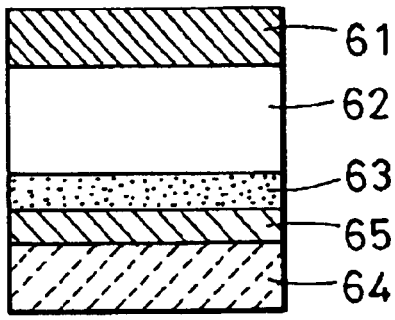
Figure 4C:
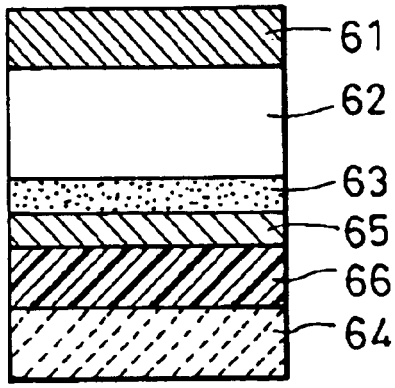

Exemplary layer structures of the electrophotographic photosensitive member are shown in FIGS. 4A to 4C. As shown in FIGS. 4A to 4C, the photosensitive member comprises a support 64, a charge generating layer 63, a charge transporting layer 62, and a charge injection layer 61, the layers 64 to 61 being stacked sequentially in that order on the support 64, the charge injection layer 61 being the outermost layer of the photosensitive member. An intermediate layer 66 may be provided between the support 64 and the charge generating layer 63, as shown in FIG. 4C. A conductive layer 65 may be formed on the support 64, as shown in FIG. 4B.

The support 64 may be made of aluminum, an aluminum alloy or stainless steel so as to be conductive. Alternatively, the support 64 may comprise a layer deposited by vacuum evaporation or the like using aluminum, an aluminum alloy, an alloy of indium oxide and tin oxide, or the like. The support 64 may comprise plastic or paper impregnated with conductive fine particles such as carbon black, tin oxide, titanium oxide, or silver particles along with a suitable binder, or may comprise plastic having a conductive binder.

The conductive layer 65 may be provided between the support 64 and the conductive layer 65 to prevent the generation of interference patterns and to coat the flaws of the support 64. The conductive layer 65 may be formed by dispersing conductive particles such as carbon black or metal particles into a binder resin. A suitable amount of fine silica particles may be effectively added to prevent the generation of interference patterns. The thickness of the conductive layer 65 is preferably 2 to 40 $\mu$m, and more preferably, 5 to 25 $\mu$m. The surface of the support 64 may be cut, roughened, or subjected to alumite treatment in order to suppress the generation of interference patterns.

The intermediate layer 66, which bonds layers and functions as a charge barrier, may be provided on the support 64 or the conductive layer 65. Examples of materials of the intermediate layer 66 include polyamides, polyvinyl alcohols, polyethylene oxides, ethyl cellulose, casein, polyurethanes, and polyether polyurethanes. The material is dissolved in a suitable solvent and applied. The intermediate layer 66 preferably has a thickness of 0.05 μm to 5 μm, and more preferably, 0.3 μm to 1.5 μm.

Examples of charge generating substances used in the present invention include phthalocyanine pigment, azo pigment, indigo pigment, polycyclic quinone pigment, perylene pigment, quinacridone pigment, azulenium salt pigment, pyrylium dye, thiopyrylium dye, squalilium dye, cyanine dye, xanthene dye, quinoimine dye, triphenylmethane dye, styryl dye, selenium, selenium-tellurium, amorphous silicon, cadmium sulfide and zinc oxide. Phthalocyanine pigment and azo pigment are preferable since they have high sensitivity that can meet the recent trends toward digital developing. Phthalocyanine pigment is particularly preferable.

In the composite photosensitive member, the solvent used for coating for making the charge generating layer 63 is selected based on the solubility and dispersion stability of the resin and the charge generating substance. As an organic solvent, alcohols, sulfoxides, ketones, ethers, esthers, aliphatic halogenated hydrocarbons, aromatic compounds or the like can be used.

The charge generating layer 63 is formed by uniformly dispersing the above-described charge generating substance into a mixture of a binder resin and a solvent corresponding to 0.3 to 4 times the amount of the charge generating substance using a homogenizer, ultrasonic waves, a ball mill, a sand mill, an attritor, a roll mill, or the like. The dispersed substance is then applied and dried. The charge generating layer 63 preferably has a thickness of 5 μm or less, and more preferably, 0.01 μm to 1 μm.

Examples of charge transporting substances include amine system compounds, oxazole system compounds, and thiazole system compounds known in the art.

In the composite photosensitive member, the charge transporting layer 62 is generally formed by dissolving the above charge transporting substance and a binder resin in a solvent to prepare a solution, and applying the solution. The mixing ratio of the charge transporting substance to the binder resin is approximately 2:1 to 1:2. Examples of solvents include ketones such as acetone and methyl ethyl ketone, esters such as methyl acetate and ethyl acetate, aromatic hydrocarbons such as toluene and xylene, and chlorinated hydrocarbons such as chlorobenzene, chloroform, and carbon tetrachloride. In applying the solution, dip coating, spray coating, or spinner coating may be used, for example. Drying is preferably performed at a temperature of 10° C. to 200° C., and more preferably 20° C. to 150° C., for 5 minutes to 5 hours, and more preferably 10 minutes to 2 hours, in circulating air or in a still atmosphere.

Examples of binder resins used to form the charge transporting layer 62 include acrylic resins, styrene resins, polyesters, polycarbonate resins, polyarylates, polysulfones, polyphenylene oxides, epoxy resins, polyurethane resins, alkyd resins, and unsaturated resins known in the art. A polymethylmethacrylate resin, a polystyrene resin, styrene-acrylonitrile copolymers, a polycarbonate resin, and a diallyl phthalate resin are particularly preferable. The thickness of the charge transporting layer 62 is preferably 5 μm to 40 μm, and more preferably, 10 μm to 30 μm.

Various additives such as antioxidants, UV absorbers, and elasticizers may be contained in the charge generating layer 63 and the charge transporting layer 62.

The electrophotographic photosensitive member of the present invention preferably has a charge injection layer on the surface so that the surface of the electrophotographic photosensitive member is charged by directly injecting charges into the charge injection layer from a contact charging member. This structure is preferable because it ensures stable charge characteristics.

The thickness of the charge injection layer is preferably in the range of 0.5 μm to 10 μm, and more preferably 1 μm to 7 μm.

The charge injection layer preferably contains binder resin and conductive particles. The charge injection layer may further contain a charge transporting substance.

When the charge injection layer is made by dispersing the conductive particles into the binder resin to adjust the resistance, an electrically insulative, transparent resin that does not change its electrical resistance due to changes in humidity or temperature is used as the binder resin. Since the charge injection layer constitutes the surface of the electrophotographic photosensitive member, the binder resin needs to have a high strength to satisfy the recent demand for high speed, high durability, and high quality printing.

In the present invention, a curable resin is preferably used as the binder resin of the charge injection layer. Curable resins, when used in the charge injection layer, have a small variation in resistance and in a high temperature-high humidity environment and in a normal temperature-low humidity environment. Moreover, curable resins have high surface hardness, high abrasion resistance, high particle dispersibility, and superior stability after dispersion.

As the binder resin, phenol resins, epoxy resins, and siloxy resins are preferable. Phenol resins are particularly preferable. Resol-type phenol resins, particularly, thermosetting resol-type phenol resins are yet more preferable.

Generally, resol-type phenol resins are made by reacting a phenol compound with an aldehyde compound in the presence of an alkali catalyst. Examples of the phenol compounds include phenols, cresols, xylenols, paraalkylphenols, paraphenylphenols, resorcins, and bisphenols. Examples of the aldehyde compounds include formaldehydes, paraformaldehydes, furfurals, and acetoaldehydes. These phenol and aldehyde compounds are not limited to these examples.

The phenol compound is reacted with the aldehyde compound in the presence of an alkali catalyst so as to form monomers of monomethylolphenols, dimethylolphenols, and trimethylolphenols, mixtures of these, and the corresponding oligomers. Relatively large molecules having approximately 2 to 20 repeating units are oligomers, and those with one repeating unit are monomers.

Examples of alkali catalysts include metal alkali compounds, ammonia, and amine compounds. Examples of the metal alkali compounds include hydroxides of alkali metals and alkali earth metals such as NaOH, KOH, and $Ca(OH)_2$. Examples of the amine compounds include ammonia, hexamethylenetetramine, trimethylamine, triethylamine, and triethanolamine. These compounds and catalysts are not limited to these examples. Considering the changes in resistance in a high-humidity environment, ammonia and amine compounds are preferably used. More preferably, amine compounds are used in view of securing the stability of the solution.

When a thermosetting resin is used as the binder resin of the charge injection layer, the applied precursor of the charge injection layer is normally cured in a hot air drying furnace. The curing temperature is preferably in the range of 100° C. to 300° C., and more preferably, 120° C. to 200° C.

In the present invention, the phrase "the resin is cured" refers to the state in which the resin is not dissolved in an alcohol solvent such as methanol or ethanol.

As the conductive particles that function as the resistance adjustor contained in the charge injection layer, metal oxides such as ZnO, $TiO_X$, $SnO_2$, $In_2O_3$, $SnO_2$ containing $Sb_3O_2$, $SnO_2$ containing $In_2O_3$, $V_2O_5$, $MoO_3$, NiO, and CuO, and metal particles are preferably used. These conductive particles may be used in combination. Among these materials, a solid solution of $SnO_2$ and antimony (Sb), a solid solution of $SnO_2$ and $Sb_3O_2$, or $SnO_2$, which form a substantially transparent charge injection layer having low electrical resistance, are particularly preferable.

The ratio of the conductive particles to the binder resin directly determines the electrical resistivity of the charge injection layer. The content of the conductive particles is preferably adjusted so that the electrical resistance of the charge injection layer is in the range of $10^9$ to $10^{14}$ Ω·cm.

At an electrical resistivity exceeding $10^{14}$ Ω·cm, the charge injection efficiency in direct injection charging decreases, which may result in a charging failure and fogging of the images due to an increased residual potential. At an electrical resistivity less than $10^9$ Ω·cm, blurring of the images and degradation in the resolution readily occur.

The strength of the charge injection layer decreases as the amount of the conductive particles increases. Thus, the amount of the conductive particles is preferably as low as the resistivity and the residual potential of the charge injection layer permits.

The charge injection layer must not obstruct the transmission of light used for the exposure. If the grain diameter of the conductive particles dispersed in the binder resin is excessively large, the charge injection layer becomes opaque, resulting in decreased sensitivity and image density. The grain diameter of the conductive particles is preferably less than the wavelength of the light used for the exposure, i.e., 0.42 μm to 0.8 μm. The grain diameter is more preferably half of the wavelength of the light used for the exposure, i.e., 0.3 μm, or less, and yet more preferably, 0.1 μm or less.

Herein, the grain diameter is the volume-average grain diameter.

In introducing the conductive particles into the charge injection layer, the conductive particles are preferably used with surfactants or subjected to surface treatment to improve their dispersibility in the binder resin and prevent resistance change. The surface treatment is preferably performed with a silane coupling agent, a titanate coupling agent, an isocyanate compound, a siloxane compound, or a fluorine compound. The siloxane compounds and the fluorine compounds are particularly preferable as the surface treating agent of the conductive particles.

Preferably, the charge injection layer contains lubricant particles. The preferable examples of lubricant particles are fluorinated resin particles, silicone particles, silicon particles, and alumina particles. The fluorinated resin particles are particularly preferable. These particles may be used in combination.

The preferable examples of the fluorinated resin particles include particles of ethylene tetrafluoride resin, ethylene chloride trifluoride resin, ethylene propylene hexafluoride resin, vinyl fluoride resin, vinylidene fluoride resin, ethylene dichloride difluoride resin, and copolymers of these. Particles of ethylene tetrafluoride resin and vinylidene fluoride resin are particularly preferable. These particles may be used alone or in combination. No limit is imposed as to the molecular weight and the grain diameter of the particles. They may be suitably selected according to needed requirements.

Inorganic particles such as silicon particles and alumina particles may not function as a lubricant alone. However, the inventors have found that when these inorganic particles are dispersed into the charge injection layer, they increase the surface roughness and thus enhance the lubricity of the surface of the charge injection layer.

It should be noted that, in the present invention, the term "lubricant particles" refers to the particles which provide lubricity to the layer surface.

In order to prevent agglomeration of the fluorinated resin particles and conductive particles in the binder resin solution, a fluorine compound may be added to the solution at the same time as dispersion of the conductive particles, or the surfaces of the conductive particles may be treated with a fluorine compound.

By adding a fluorine compound and by treating the surfaces of the conductive particles using a fluorine compound, the dispersibility and dispersion stability of the conductive particles and the fluorinated resin particles in the binder resin solution are improved dramatically compared to the case where no fluorine compound is used.

When fluorinated resin particles are dispersed into a solution containing a fluorine compound and dispersed conductive particles or into a solution containing conductive particles subjected to surface treatment, no secondary particles are formed and a coating solution exhibiting superior stability over time and superior dispersibility can be obtained.

Examples of fluorine compounds include fluorinated silane coupling agents, fluorine-modified silicone oils, and fluorinated surfactants.

The preferable examples of the compound are listed in Tables 1 to 3. These coupling agents, oils, and surfactants are not limited to these examples.

TABLE 1

| Examples of fluorinated silane coupling agents |
|---|
| $CF_3CH_2CH_2Si(OCH_3)_3$ |
| $C_4F_9CH_2CH_2Si(OCH_3)_3$ |
| $C_6F_{13}CH_2CH_2Si(OCH_3)_3$ |
| $C_8F_{17}CH_2CH_2Si(OCH_3)_3$ |
| $C_8F_{17}CH_2CH_2Si(OCH_2CH_2OCH_3)_3$ |
| $C_{10}F_{21}Si(OCH_3)_3$ |
| $C_6F_{13}CONHSi(OCH_3)_3$ |
| $C_8F_{17}CONHSi(OCH_3)_3$ |
| $C_7F_{15}CONHCH_2CH_2CH_2Si(OCH_3)_3$ |
| $C_7F_{15}CONHCH_2CH_2CH_2Si(OC_2H_6)_3$ |
| $C_7F_{15}COOCH_2CH_2CH_2Si(OCH_3)_3$ |
| $C_7F_{15}COSCH_2CH_2CH_2Si(OCH_3)_3$ |
| $C_7F_{15}SO_2NHCH_2CH_2CH_2Si(OC_2H_6)_3$ |
| $C_8F_{17}SO_2N(CH_2CH_2CH_3)CH_2CH_2CH_2Si(OCH_3)_3$ |
| $C_8F_{17}CH_2CH_2SCH_2CH_2Si(OCH_3)_3$ |
| $C_{10}F_{21}CH_2CH_2SCH_2CH_2Si(OCH_3)_3$ |
| $C_7F_{15}CONHCH_2CH_2N(COC_7F_{15})CH_2CH_2CH_2Si(OCH_3)_2$ |
| $C_7F_{15}SO_2NHCH_2CH_2N(SO_2C_8F_{17})CH_2CH_2CH_2Si(OCH_3)_3$ |

TABLE 2

Examples of fluorine-modified silicone oils

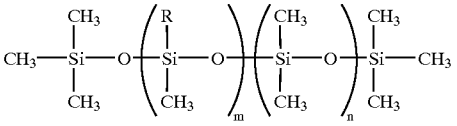

R: $—CH_2CH_2CF_3$ m and n: positive integers

TABLE 3

Examples of fluorinated surfactants $X—SO_2NRCH_2COOH$
$X—SO_2NRCH_2CH_2O(CH_2CH_2O)_nH$
(n = 5, 10, 15)
$X—SO_2N(CH_2CH_2CH_2OH)_2$
$X—RO(CH_2CH_2O)_n$ (n = 5, 10, 15)
$X—(RO)_n$ (n = 5, 10, 15)
$X—(RO)_nR$ (n= 5, 10, 15)

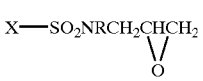

$X—COOH$, $X—CH_2CH_2COOH$
$X—ORCOOH$
$X—ORCH_2COOH$, $X—SO_3H$
$X—ORSO_3H$, $X—CH_2CH_2COOH$

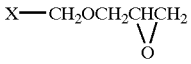

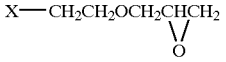

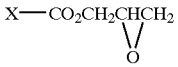

R: alkyl, aryl, or aralkyl group
X: fluorocarbon group such as $—CF_3$, $—C_4F_9$, or $—C_8F_{17}$ A siloxane compound may be added to the binder resin solution during the dispersion of the conductive particles or the surfaces of the conductive particles may be preliminarily treated with a siloxane compound so as to form a charge injection layer having superior environmental stability.

Preferably, the siloxane compound is represented by formula (1) below:

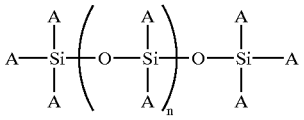

(1)

wherein A is hydrogen or methyl group, the ratio of hydrogen relative to the entirety of A is in the range of 0.1 to 50%, and n is zero or a positive integer.

With the above siloxane compound, no secondary particles of the dispersed particles are formed, and a coating solution for making a charge injection layer having superior stability over time and excellent dispersibility can be obtained. The charge injection layer made by using this coating solution has a high transparency and excellent environmental resistance.

When a curable phenol resin is used to make the charge injection layer, irregular stripes and the formation of cells may occur due to the layer thickness or other factors. This can be avoided by the above-described process of adding the siloxane compound to the binder resin solution during the dispersion of the conductive particles or preliminarily treating the surface of the conductive particles with the siloxane compound.

Moreover, the siloxane compound also has an effect as a levelling agent, which was unexpected.

No limit is imposed as to the molecular weight of the siloxane compound. When used for surface treatment, the siloxane compound preferably has a low viscosity to facilitate the process, for example, several hundreds to several tens of thousands weight-average molecular weight.

A wet process and a dry process are available for the surface treatment.

In the wet process, the conductive particles and the siloxane compound are dispersed in a solvent so as to allow the siloxane compound to adhere onto the surfaces of the particles.

In dispersion, a known dispersion means such as a ball mill or a sand mill may be used.

Next, the resulting dispersion solution is affixed onto the surfaces of the conductive particles by heating. In heating, Si—H bonds in siloxane form new siloxane bonds as hydrogen atoms are oxidized by oxygen in air during heating. As a result, the siloxane develops into a three-dimensional net structure surrounding the surfaces of the conductive particles.

The surface treatment is completed by affixing the siloxane compound onto the surfaces of the conductive particles. Alternatively, the treated particles may be crushed.

In the dry process, the siloxane compound and the metal and metal oxide particles are mixed and kneaded without using a solvent so as to allow the siloxane compound to adhere on the surfaces of the conductive particles.

The subsequent steps are the same as in the wet step. A heating step and a crushing step are performed to complete the surface treatment.

The ratio of the siloxane compound to the conductive particles depends on the grain diameter of the conductive particles, the ratio of hydrogen and methyl groups in the siloxane, and the like. Preferably, the ratio of the siloxane compound is 1 to 50 percent by mass, and more preferably, 3 to 40 percent by mass.

Alternatively, an additive such as an antioxidant may be added to the charge injection layer.

The present invention is now described by way of examples. The examples below by no means limit the scope of the present invention within the spirit of the present invention. In the examples below, the term "part" represents "part by mass".

Examples 1 to 7 and Comparative Examples 1 to 3 below were evaluated using an electrophotographic apparatus (printer) having the following configuration.

Referring to FIG. 6, the printer is a modified model of a laser printer (LaserJet 4000, Hewlett-Packard Co.) which employs a transfer electrophotographic process, a direct injection charging method, and a toner recycling system. The printer has no dedicated cleaning units.

The electrophotographic photosensitive member 1 comprises a 30-mm rotatable-drum organic photoconductor (OPC) of negative polarity which rotates at a 110 mm/s process speed.

The voltage applied to the charging unit 2 from the power supply S1 is DC-620V.

The charged particle support is made by forming the rubber intermediate resistance layer (elastic layer) 2*b* on the core bar 2*a* having an outer diameter of 6 mm and a longitudinal length of 250 mm. The intermediate resistance layer (elastic layer) 2*b* has a thickness of 3 mm and a longitudinal length of 20 mm. The intermediate resistance layer (elastic layer) 2*b* is made of a urethane resin, conductive particles (carbon black), a sulfurizing agent, and a foaming agent and is formed on the core bar 2*a* to make a roller. The surface of the resulting roller is polished so as to make a roller having a diameter of 12 mm and a longitudinal length of 250 mm. The surface of the roller is porous.

The charged particle support is arranged to produce a deformation amount of 0.3 mm relative to the electrophotographic photosensitive member 1 so as to make the charge contact region n approximately 2 mm. The charge contact region n is formed by pressing the charged particle support onto the electrophotographic photosensitive member 1 so that a total load of 1 kg is applied on the core bar 2*a* of the charged particle support.

The charged particle support is driven at 150 rpm to counter-rotate relative to and at the same speed as the surface of the electrophotographic photosensitive member.

The charged particle support has a surface roughness Ra of 40 $\mu$m and an Asker C hardness of 22 degrees.

The charged particle support has a surface resistivity of $10^7$ Ω and a volume resistivity of $10^6$ Ω·cm. The roller resistance is $10^5$ Ω. The roller resistance is measured by applying a 100 V voltage to the core bar 2*a* of the charged particle support and to the support member of the electrophotographic photosensitive member while forming the charge contact region n.

A superimposed voltage of a DC voltage and an AC voltage is used as the developing bias voltage. The electrostatic latent image on the electrophotographic photosensitive member is reversed and developed with toner. The average grain diameter D4 of the toner is 7 $\mu$m.

The charged particles comprise a white conductive zinc oxide having a resistivity of $10^6$ Ω·cm and an average grain diameter of 3 $\mu$m. The resistivity is measured by a tablet method and by normalizing the results. In particular, 0.5 g charged particles are placed in a cylinder having a base area of 2.26 $cm^2$, and a pressure of 15 kg and a voltage of 100 V are applied to upper and lower electrodes so as to measure the resistivity, and the results are normalized.

The charged particles and toner are contained in the development container. The frictional charging of the charged particles relative to the iron carrier is +5 $\mu$C/g.

Moreover, in order to uniformly supply the charged particles at the charge contact region n between the electrophotographic photosensitive member and the charged particle support, the charge particle supplier is provided. The regulating blade abuts the electrophotographic photosensitive member, and the charged particles are held between the electrophotographic photosensitive member and the regulating blade. A predetermined amount of charged particles are applied on the charged particle support as the electrophotographic photosensitive member is rotated.

In the electrophotographic apparatus, the charged particles at the charge contact region n between the charged particle support and the electrophotographic photosensitive member 1 thoroughly rub the surface of the charged particle support to perform injection charging.

The amount of the charged particles supported by the charged particle support is 4 mg/$cm^2$. The ratio of the surface of the charged particle support coated with the charged particles supported by the charged particle support (coating ratio) is 0.8.

The transferring unit comprises a transfer roller having a resistance of $5\times10^8$ Ω. Transfer is performed by applying a +2.0 kV voltage to the core bar of the roller.

The difference in charge potential between the first rotation and the second rotation of the electrophotographic photosensitive member is measured at a position where the developing unit is disposed and after the electrophotographic photosensitive member is charged. The surface potential difference is measured as the charging potential difference.

EXAMPLE 1

To a solution of 60 parts of methanol and 40 parts of butanol, 10 parts of copolymerized polyamide resin (trade name: AMILAN CM8000, Toray Industries, Inc.) was dissolved. The resulting solution was applied on an aluminum cylinder by dip-coating and dried at 90° C. for 10 minutes to make an intermediate layer having a thickness of 0.5 $\mu$m.

Next, a solution of 3 parts of hydroxygallium phthalocyanine pigment represented by formula (2) below and distinct peaks at Bragg angles (2θ±0.2°) of 7.4°, 16.6°, 25.5°, and 28.2° in CuKα X-ray diffraction, 2 parts of polyvinyl butyral resin (trade name: S-LEC BX-1, Sekisui Chemical Co., Ltd), and 70 parts of cyclohexanone was dispersed using a sand mill for 10 hours. To the dispersed solution, 100 parts of ethyl acetate was added to prepare coating solution for making the charge generating layer. The resulting coating solution was applied on the intermediate layer by dip-coating, dried at 90° C. for 10 minutes so as to form a charge generating layer having a thickness of 0.17 $\mu$m.

(2)

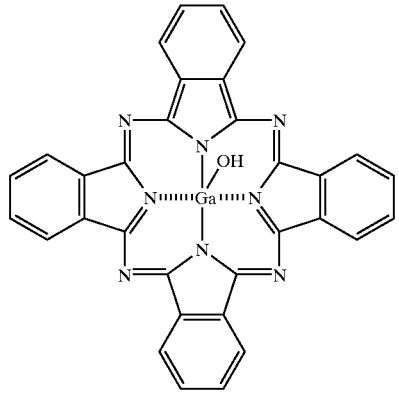

Next, 7 parts of a triarylamine compound represented by formula (3) below:

(3)

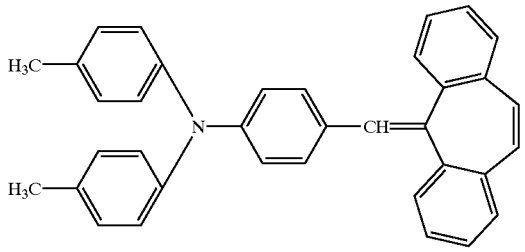

and 10 parts of polycarbonate (trade name: Iupilon Z-200, Mitsubishi Engineering Plastics Co.) were dissolved in 70 parts of chlorobenzene to prepare a solution. The prepared solution was applied on the charge generating layer by dip-coating and dried at 110° C. for one hour to make a charge transporting layer having a thickness of 20 $\mu$m.

To prepare the charge injection layer, 50 parts of antimony-doped zinc oxide micro particles, the surface of the particles being preliminarily treated using a compound represented by formula (4) below at a 7% throughput, (4)

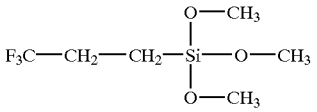

and 150 parts of ethanol are dispersed using a sand mill for 66 hours. The average grain diameter was 0.03 μm. The resulting dispersed mixture was dissolved into 30 parts of the resin component of a resol-type phenol resin (trade name: PL-4804; using an amine compound catalyst, Ei-gun Chemical Industry Co., Ltd.) to prepare a stock solution. The stock solution was applied on the charge transporting layer by dip-coating method to form a layer, was dried by hot air at 145° C. for 1 hour so as to prepare an electrophotographic photosensitive member comprising a charge transporting layer having a thickness of 4 μm. The precursor coat of the charge injection layer had satisfactory dispersion, and the resulting charge injection layer was uniform.

The resulting electrophotographic photosensitive member was installed to the above-described modified model of LaserJet 4000 to measure ΔVd. The result was 40 V.

Halftone images were output using the above-described apparatus. If injection charging was not satisfactory, black streaks would appear on the output image as a result of reversal developing. Also, the charge potential in the second rotation of the electrophotographic photosensitive member would become lower than that in the first rotation, and image failures, such as increased image density on some of the output halftone images, would occur. However, in the apparatus comprising the electrophotographic photosensitive member of the present invention, no increase in density was observed, and high quality images were output even after 1000 sequential outputs. Moreover, the surface of the photosensitive member after output was observed with a microscope; no damage was found on the surface of the photosensitive member.

EXAMPLE 2

An electrophotographic photosensitive member was prepared as in EXAMPLE 1 except that the charge generating layer, the charge transporting layer, and the charge injection layer were formed on the intermediate layer as below.

A solution of 2 parts of oxytitanium phthalocyanine pigment represented by formula (5) below and having distinct peaks at Bragg angles (2θ±0.2°) of 9.0° and 27.1° in CuKα X-ray diffraction, (5)

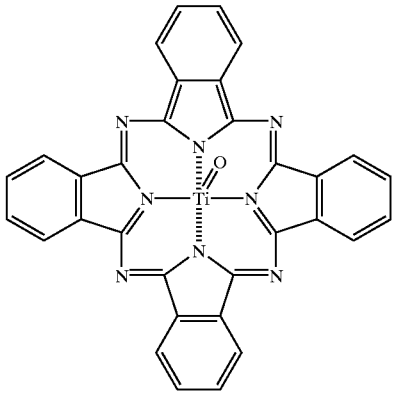

and 2 parts of polyvinyl butyral resin (trade name: S-LEC BX-1, Sekisui Chemical Co., Ltd), 70 parts of cyclohexanone was dispersed using a sand mill for 10 hours. To the dispersed solution, 100 parts of ethyl acetate was added to prepare coating solution for making the charge generating layer. The resulting coating solution was applied on the intermediate layer by dip-coating, dried at 90° C. for 10 minutes so as to form a charge generating layer having a thickness of 0.17 μm.

Next, 7 parts of a triarylamine compound represented by formula (6) below:

(6)

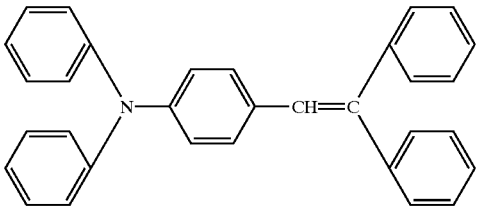

and 10 parts of polycarbonate (trade name: Iupilon Z-200, Mitsubishi Engineering Plastics Co.) were dissolved in 70 parts of chlorobenzene to prepare a solution. The prepared solution was applied on the charge generating layer by dip-coating and dried at 110° C. for one hour to make a charge transporting layer having a thickness of 15 μm.

To prepare the charge injection layer, 50 parts of antimony-doped zinc oxide micro particles, the surface of the particles being preliminarily treated using a compound represented by formula (4) above at a 7% throughput, 30 parts of a melamine resin (trade name: Cymel 701, Mitsui Cytec Ltd.), 150 parts of ethanol were dispersed using a sand mill for 66 hours to prepare a stock solution.

The stock solution was applied on the charge transporting layer of the electrophotographic photosensitive member 1 by dip-coating, and was dried with hot air at 150° C. for one hour so as to make a charge injection layer having a thickness of 3 μm.

The prepared electrophotographic photosensitive member was installed to the above-described modified model of LaserJet 4000 to measure ΔVd. The result was 69 V.

As in EXAMPLE 1, halftone images were output using this apparatus. Slight ghosting of an acceptable degree was observed. The surface of the photosensitive member after 1000 sequential outputs was observed with a microscope; no damage was found on the surface of the photosensitive member.

COMPARATIVE EXAMPLE 1

The electrophotographic photosensitive member was prepared as in EXAMPLE 1 except that the thickness of the electrophotographic photosensitive member was 15 μm, the content of the melamine resin used to form the charge injection layer was changed from 30 parts to 10 parts, and the thickness of the charge injection layer was 1.5 μm. The measurement was performed as in EXAMPLE 1 and ΔVd was 75 V. Halftone images were output, but image failures, i.e., a significant increase in density, occurred. This was because some of the charge remained in the region of the electrophotographic photosensitive member carrying hysteresis of charging and exposing of the first rotation, and the potential of that region decreased during charging in the second rotation, thereby generating image failures, i.e., increased densities. The surface of the electrophotographic photosensitive member after 1000 sequential outputs was observed with a microscope; no damage was found on the surface of the electrophotographic photosensitive member.

COMPARATIVE EXAMPLE 2

The electrophotographic photosensitive member was prepared as in EXAMPLE 1 except that the charge generating layer of the electrophotographic photosensitive member made as in EXAMPLE 2 was prepared as below and the thickness of the charge transporting layer was 10 μm. As in EXAMPLE 2, the charge injection layer was made on the charge transporting layer to make the electrophotographic photosensitive member.

In COMPARATIVE EXAMPLE 2, 1.125 parts of trisazo pigment represented by formula (7) below, (7)

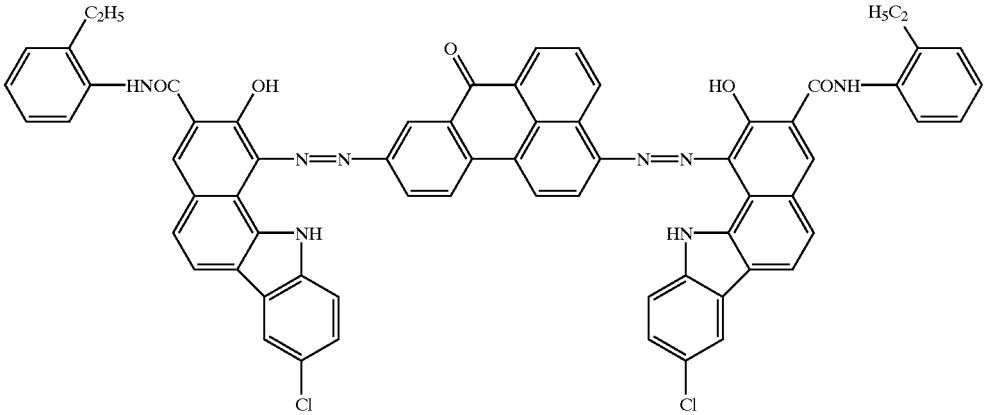

2 parts of polyvinylbenzal (80% benzal conversion, weight-average molecular weight of 12000) represented by formula (8) below, (8)

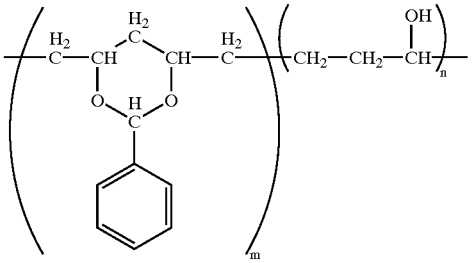

and 30 parts of cyclohexanone were dispersed using a sand mill. To the resulting dispersed mixture, 60 parts of tetrahydrofuran was added to prepare an application solution for making the charge generating layer. The application solution was applied on the intermediate layer by dip-coating and dried at 100° C. for 10 minutes so as to form a charge generating layer having a thickness of 0.4 μm.

The measurement was taken as in EXAMPLE 1, and ΔVd was 70 V. Halftone images were output, which contained image failures, i.e., increased densities. The surface of the electrophotographic photosensitive member after 1000 sequential outputs was observed using a microscope; no damage was found on the surface of the photosensitive member.

EXAMPLE 3

The electrophotographic photosensitive member was prepared as in EXAMPLE 1 except that the charge injection layer was formed as below.

To prepare the coating material for the charge injection layer, 50 parts of antimony-doped zinc oxide micro particles, the surface of the particles being preliminarily treated using a compound represented by formula (4) above at a 7% throughput and 150 parts of ethanol were dispersed using a sand mill for 66 hours to prepare a dispersed solution. Next, 20 parts of charge transporting substance represented by formula (9) below and 30 parts of the resin component of the resol-type curable resin (trade name: PR-53123, 45% non-volatile content, Sumitomo Durez Co., Ltd.) were dissolved in the above dispersed solution to make a coating material for making the charge injection layer. The coating material was applied on the charge transporting layer and dried by hot air at 145° C. for one hour so as to make the electrophotographic photosensitive member including a charge injection layer having a thickness of 2.0 μm.

(9)

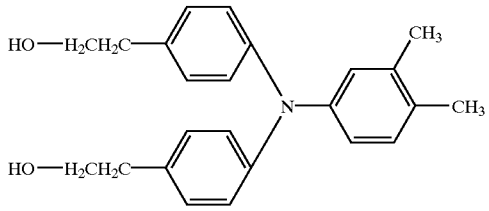

Using the modified model of LaserJet 4000 as in EXAMPLE 1, ΔVd of the resulting electrophotographic photosensitive member was measured; ΔVd was 34 V. Halftone images were output, and the output images had high quality without an increase in density. The surface of the electrophotographic photosensitive member after 1000 sequential output was examined using a microscope; no damage was found on the surface of the electrophotographic photosensitive member.

EXAMPLE 4

The intermediate layer and the charge generating layer, each having a thickness of 0.2 μm, were formed on an aluminum cylinder as in EXAMPLE 1. The charge transporting layer having a thickness of 25 μm was formed as in EXAMPLE 2. On the charge transporting layer, the charge injection layer having a thickness of 2 μm was formed as in EXAMPLE 1 to prepare the electrophotographic photosensitive member.

Using the modified model of LaserJet 4000, ΔVd of the prepared electrophotographic photosensitive member was measured. The result was 22 V. Output halftone images had high quality without an increase in density. The surface of the electrophotographic photosensitive member after 1000 sequential outputs was examined using a microscope; no damage was found on the surface of the electrophotographic photosensitive member.

EXAMPLE 5

The intermediate layer, the charge generating layer, and the charge transporting layer were sequentially formed on an aluminum cylinder as in EXAMPLE 1. Only the thickness of the charge transporting layer was changed to 10 μm. The phenol resin used to make the charge injection layer in EXAMPLE 1 was replaced with an epoxy resin made by blending Epicoat #815 and Epomate B002 (trade names, Japan Epoxy Resins Co., Ltd.) at a mass ratio of 2:1. The charge injection layer having a thickness of 1 μm was formed to prepare the electrophotographic photosensitive member.

Using the modified model of LaserJet 4000, ΔVd of the prepared electrophotographic photosensitive member was measured. The result was 21V. Output halftone images had high quality without an increase in density. The surface of the electrophotographic photosensitive member after 1000 sequential outputs was observed using a microscope; no damage was found on the surface of the electrophotographic photosensitive member.

EXAMPLE 6

The intermediate layer and the charge generating layer were formed on an aluminum cylinder as in EXAMPLE 2. The charge transporting layer having a thickness of 25 μm was then formed as in EXAMPLE 1. Instead of the phenol resin in EXAMPLE 1, methylphenylpolysiloxane (trade name: KF-50500CS, Shin-Etsu Chemical Co., Ltd.) is applied on the surface by dip-coating and dried at 160° C. for an hour to make a charge injection layer having a thickness of 2 μm.

Using the resulting electrophotographic photosensitive member, ΔVd was measured as in EXAMPLE 1. The result was 18 V. Output halftone images had high quality without an increase in density. Although high-quality images were still output after sequentially outputting 1000 sheets, small scratches, which do not affect image quality, were found on the surface of the photosensitive member after output, as observed by a microscope.

EXAMPLE 7

The intermediate layer was formed on an aluminum cylinder as in EXAMPLE 2. The charge generating layer was formed by using 5 parts, instead of 2 parts, of oxytitanium phthalocyanine. The charge transporting layer of EXAMPLE 2 was formed to a thickness of 30 μm, and the charge injection layer of EXAMPLE 5 having a thickness of 0.5 μm was formed on the charge transporting layer. Using the resulting electrophotographic photosensitive member, ΔVd was measured as in EXAMPLE 1. The result was 6 V. Output halftone images had excellent quality. Although high-quality images were still output after sequentially outputting 1000 sheets, small scratches, which do not affect image quality, were found on the surface of the photosensitive member after output, as observed by a microscope.

COMPARATIVE EXAMPLE 3

The intermediate layer was formed on an aluminum cylinder as in COMPARATIVE EXAMPLE 2. The thickness of the charge generating layer was 0.1 μm. The charge transporting layer was applied as in EXAMPLE 7, and the charge injection layer was formed as below.

In preparing the charge injection layer, 50 parts of antimony-doped zinc oxide micro particles, 100 parts of UV curable acrylic resin represented by formula (10) below, 3 parts of 2-methylthioxanone, and 150 parts of ethanol were dispersed using a sand mill for 66 hours to prepare a stock solution.

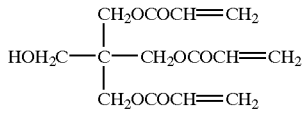

(10)

The stock solution was applied on the charge transporting layer by dip-coating so as to form the surface layer, and was cured using a high pressure mercury vapor lamp at an intensity of 800 mW/cm$^2$ for 30 seconds. Subsequently, the cured stock solution was dried by hot air at 120° C. for two hours so as to make a charge injection layer having a thickness of 3 μm The resulting electrophotographic photosensitive member was installed to the apparatus as in EXAMPLE 1 to measure ΔVd. The result was 4 V.

As in EXAMPLE 1, output halftone images exhibited no increase in density. However, after 1000 sequential outputs, the toner recovered by a charger by using the toner recycling system of the apparatus were not properly discharged onto the drum. Such discharge failure resulted in image failure. This is because an excessive amount of toner stored in the charger as a result of discharge failure contaminated the charger. The surface of the photosensitive member after output was observed by a microscope, and a considerable number of scratches were found along the driving direction. This is because the photosensitive member is rotated with the toner trapped between the developer and the photosensitive member due to discharge failure of the toner at the developer.

EXAMPLE 8

The charge injection layer was formed on the charge transporting layer as in EXAMPLE 1 except that the charge injection layer of the electrophotographic photosensitive member was prepared as below. The prepared photosensitive member was also evaluated as in EXAMPLE 1.

In preparing the charge injection layer, 30 parts of antimony-doped zinc oxide micro particles, the surface of the particles being preliminarily treated using a compound represented by formula (4) above at a 7% throughput, and 30 parts of antimony-doped zinc oxide micro particles, the surface thereof being preliminarily treated using the methylhydrogen silicone oil (trade name: KF99, Shin-Etsu Chemical Co., Ltd.) by formula (1) above at a 20% throughput were added to 150 parts of ethanol to prepare a solution, and the solution was dispersed using a sand mill for 66 hours. The average grain diameter was 0.03 μm. To the dispersed solution, 20 parts of polytetrafluoroethylene micro particles having an average grain diameter of 0.18 μm was added and the resulting mixture was dispersed for two hours.

Subsequently, 30 parts of the resin component of a resol-type phenol resin (trade name: PF-4852; using an amine compound catalyst, Ei-gun Chemical Industry Co., Ltd.) was dissolved in the resulting dispersed solution to prepare a stock solution. The stock solution was applied on the charge transporting layer by dip-coating and was dried by hot air at 145° C. for one hour to prepare an electrophotographic photosensitive member having a charge injection layer having a thickness of 4 μm. The applied stock solution had a satisfactory dispersion state, and the resulting charge injection layer was uniform.

The prepared electrophotographic photosensitive member was installed to the modified model of LaserJet 4000 used in EXAMPLE 1 to measure ΔVd. The result was 33 V.

Halftone images were output as in EXAMPLE 1 using this apparatus. High-quality images without image failure were obtained. The surface of the photosensitive member after 1000 sequential outputs was observed using a microscope; no scratches were found.

As described above, the present invention successfully provides an electrophotographic apparatus and a process cartridge for use therein that can reliably recycle toner and output high-quality images with less ghosting without damaging the electrophotographic photosensitive member which would otherwise be caused by repeating outputs.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrophotographic apparatus including a toner recycling system, said apparatus comprising:

an electrophotographic photosensitive member comprising a support and a photosensitive layer on the support;

charging means for charging the surface of said electrophotographic photosensitive member;

exposing means for exposing the charged surface of said electrophotographic photosensitive member to form an electrostatic latent image;

developing means for developing the electrostatic latent image with toner so as to form a toner image;

transferring means for transferring the toner image onto a recording medium; and fixing means for fixing the toner image on the recording medium, said charging means comprising a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising charged particles that come into contact with said electrophotographic photosensitive member and a charged particle support configured and positioned to support the charged particles, the surface of said charged particle support being conductive and elastic, said charging means also being means for supporting residual toner on the surface of said electrophotographic photosensitive member after transfer of the toner image by said transferring means, for normalizing the electrical charge of the normalized residual toner, and for returning the residual toner onto the surface of said electrophotographic photosensitive member, said developing means also being means for recovering the normalized residual toner returned onto the surface of said electrophotographic photosensitive member, wherein the absolute value of the charge potential difference between a first rotation and a second rotation of said electrophotographic photosensitive member is higher than 5 V and lower than 70 V, wherein said electrophotographic photosensitive member further comprises a charge injection layer at the surface thereof, wherein the surface of said electrophotographic photosensitive member is charged by direct injection of electrical charge from said contact charging member to said charge injection layer, wherein said charge injection layer comprises a binder resin and at least one of conductive particles and a charge transporting substance, wherein the binder resin comprises a curable resin, and wherein the curable resin is at least one resin selected from the group consisting of phenol resins, epoxy resins, and siloxane resins.

2. The electrophotographic apparatus according to claim 1, wherein the absolute value of the charge potential difference is higher than 20 V and lower than 70 V.

3. The electrophotographic apparatus according to claim 1, wherein the binder resin is a phenol resin, and the phenol resin is a resol-type phenol resin.

4. The electrophotographic apparatus according to claim 3, wherein the resol-type phenol resin is synthesized by using one of ammonia and an amine compound.

5. The electrophotographic apparatus according to claim 3, wherein the resol-type phenol resin is synthesized by using an amine compound.

6. The electrophotographic apparatus according to claim 5, wherein the resol-type phenol resin is of a thermosetting type.

7. The electrophotographic apparatus according to claim 1, wherein the conductive particles are metal particles or metal oxide particles.

8. The electrophotographic apparatus according to claim 1, wherein said charge injection layer further comprises at least one of a fluorine compound and a siloxane compound.

9. The electrophotographic apparatus according to claim 1, wherein said charge injection layer further comprises a fluorine compound selected from the group consisting of fluorinated silane coupling agents, fluorine-modified silicone oils, and a fluorine-type surfactant.

10. The electrophotographic apparatus according to claim 1, wherein said charge injection layer further comprises a siloxane compound represented by formula (1):

(1)

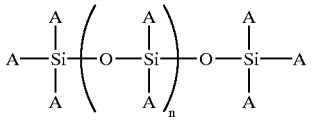

wherein A is hydrogen or methyl group, the ratio of hydrogen in the entirety of A is in the range of 0.1 to 50%, and n is zero or a positive integer.

11. The electrophotographic apparatus according to claim 1, wherein said charge injection layer further comprises lubricant particles.

12. The electrophotographic apparatus according to claim 11, wherein the lubricant particles are at least one selected from the group consisting of fluorine resin particles, silicone particles, silicon particles, and alumina particles.

13. The electrophotographic apparatus according to claim 1, wherein the charged particles comprise conductive particles having a grain diameter in the range of 10 nm to 10 $\mu$m, the resistivity of the charged particles being in the range of $10^{-1}$ Ω·cm to $10^{12}$ Ω·cm, and the amount of the charged particles supported on said charged particle support being in the range of 0.1 mg/cm$^2$ to 50 mg/cm$^2$.

14. The electrophotographic apparatus according to claim 1, wherein the ratio of the portion of the surface of said charged particle support covered by the charged particles to the entire surface of said charged particle support is in the range of 0.2 to 1.

15. The electrophotographic apparatus according to claim 1, wherein the surface roughness Ra of said charged particle support is in the range of 1 $\mu$m to 500 $\mu$m, and the resistivity of said charged particle support is in the range of $10^4$ Ω·cm to $10^{10}$ Ω·cm.

16. The electrophotographic apparatus according to claim 1, wherein said charged particle support is elastic and has a porous surface.

17. The electrophotographic apparatus according to claim 1, said charging means further comprising a charged particle supplier configured and positioned to supply the charged particles on said charged particle support.

18. A process cartridge, detachably attachable to a main body of an electrophotographic apparatus, said process cartridge comprising:

an electrophotographic photosensitive member comprising a support and a photosensitive layer;

charging means for charging the surface of said electrophotographic photosensitive member;

developing means for developing an electrostatic latent image with toner so as to form a toner image, the electrostatic latent image being formed on the charged surface of said electrophotographic photosensitive member by using exposing means of the electrophotographic apparatus;

transferring means for transferring the toner image onto a recording medium; and fixing means for fixing the toner image on the recording medium, said charging means comprising a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising charged particles that come into contact with said electrophotographic photosensitive member and a charged particle support configured and positioned to support the charged particles, the surface of said charged particle support being conductive and elastic, said charging means also being means for supporting residual toner on the surface of said electrophotographic photosensitive member afler the toner image formed on the surface of said electrophotographic photosensitive member by using said developing means is transferred onto the recording medium through said transferring means, for normalizing the electrical charge of the residual toner, and for returning the residual toner onto the surface of said electrophotographic photosensitive member, said developing means also being means for recovering the normalized residual toner returned onto the surface of said electrophotographic photosensitive member, wherein the absolute value of the charge potential difference between a first rotation and a second rotation of said electrophotographic photosensitive member, is higher than 5 V and lower than 70 V, wherein said electrophotoaraphic photosensitive member further comprises a charge injection layer at the surface thereof, wherein the surface of said electrophotogranhic photosensitive member is charged by direct injection of electrical charge from said contact charging member to said charge injection layer, wherein said charge injection layer comprises a binder resin and at least one of conductive particles and a charge transporting substance, wherein the binder resin comprises a curable resin, and wherein the curable resin is at least one resin selected from the group consisting of phenol resins, epoxy resins, and siloxane resins.

19. The process cartridge according to claim 18, wherein the absolute value of the charge potential difference is higher than 20 V and lower than 70 V.

20. The process cartridge according to claim 18, wherein the binder resin is a phenol resin, and the phenol resin is a resol-type phenol resin.

21. The process cartridge according to claim 20, wherein the resol-type phenol resin is synthesized by using one of ammonia and an amine compound.

22. The process cartridge according to claim 20, wherein the resol-type phenol resin is synthesized by using an amine compound.

23. The process cartridge according to claim 22, wherein the resol-type phenol resin is of a thermosetting type.

24. The process cartridge according to claim 18, wherein the conductive particles are metal particles or metal oxide particles.

25. The process cartridge according to claim 18, wherein said charge injection layer further comprises at least one of a fluorine compound and a siloxane compound.

26. The process cartridge according to claim 18, wherein said charge injection layer further comprises a fluorine compound selected from the group consisting of fluorinated silane coupling agents, fluorine-modified silicone oils, and fluorine-type surfactant.

27. The process cartridge according to claims 18, wherein said charge injection layer further comprises a siloxane compound represented by formula (1):

(1)

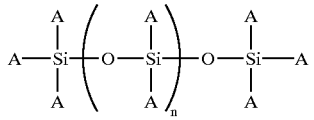

wherein A is hydrogen or methyl group, the ratio of hydrogen in the entirety of A is in the range of 0.1 to 50%, and n is zero or a positive integer.

28. The process cartridge according to claim 18, wherein said charge injection layer further comprises lubricant particles.

29. The process cartridge according to claim 28, wherein said lubricant particles are at least one selected from the group consisting of fluorine resin particles, silicone particles, silicon particles, and alumina particles.

30. The process cartridge according to claim 18, wherein the charged particles comprise conductive particles having a grain diameter in the range of 10 nm to 10 $\mu$m, the resistivity of the charged particles being in the range of $10^{-1}$ Ω·cm to $10^{12}$ Ω·cm, and the amount of the charged particles supported on said charged particle support being in the range of 0.1 mg/cm$^2$ to 50 mg/cm$^2$.

31. The process cartridge according to claim 18, wherein the ratio of the portion of the surface of said charged particle support covered by the charged particles to the entire surface of said charged particle support is in the range of 0.2 to 1.

32. The process cartridge according to claim 18, wherein the surface roughness Ra of said charged particle support is in the range of 1 μm to 500 μm, and the resistivity of said charged particle support is in the range of $10^4$ Ω·cm to $10^{10}$ Ω·cm.

33. The process cartridge according to claim 18, wherein said charged particle support is elastic and has a porous surface.

34. The process cartridge according to claim 18, said charging means comprising a charged particle supplier configured and positioned to supply the charged particles on said charged particle support.

35. An electrophotographic apparatus including a toner recycling system, said apparatus comprising:

an electrophotographic photosensitive member comprising a support and a photosensitive layer on said support;

a charger configured and positioned with respect to said electrophotographic photosensitive member to charge the surface of said electrophotographic photosensitive member;

an exposing device configured and positioned with respect to said electrophotographic photosensitive member to expose the charged surface of said electrophotographic photosensitive member to form an electrostatic latent image;

a developing device configured and positioned with respect to said electrophotographic photosensitive member to develop the electrostatic latent image with toner so as to form a toner image;

a transferring device configured and positioned with respect to said electrophotographic photosensitive member to transfer the toner image onto a recording medium; and a fixing device configured and positioned with respect to the recording medium to fix the toner image on the recording medium, wherein said charger comprises a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising:

charged particles that come into contact with said electrophotographic photosensitive member; and a charged particle support configured and positioned to support the charged particles, the surface of said charged particle support being conductive and elastic, said charger being configured and positioned to support residual toner on the surface of said electrophotographic photosensitive member after transfer of the toner image by said transferring device, said charger also being configured and positioned to normalize the electrical charge of the residual toner, said charger further being configured and positioned to return the normalized residual toner onto the surface of said electrophotographic photosensitive member, said developing device being configured and positioned with respect to said electrophotographic photosensitive member and said charger to recover the normalized residual toner returned onto the surface of said electrophotographic photosensitive member, wherein the absolute value of the charge potential difference between a first rotation and a second rotation of said electrophotographic photosensitive member is higher than 5 V and lower than 70 V, wherein said electrophotographic photosensitive member further comprises a charge injection layer at the surface thereof, wherein the surface of said electrophotographic photosensitive member is charged by direct injection of electrical charge from said contact charging member to said charge injection layer, wherein said charge injection layer comprises a binder resin and at least one of conductive particles and a charge transporting substance, wherein the binder resin comprises a curable resin, and wherein the curable resin is at least one resin selected from the group consisting of phenol resins, epoxy resins, and siloxane resins.

36. A process cartridge, detachably attachable to a main body of an electrophotographic apparatus, said process cartridge comprising:

an electrophotographic photosensitive member comprising a support and a photosensitive layer;

a charging device configured and positioned with respect to said electrophotographic photosensitive member to charge said electrophotographic photosensitive member;

a developing device configured and positioned with respect to said electrophotographic photosensitive member to develop an electrostatic latent image with toner so as form a toner image, the electrostatic latent image being formed on the charged surface of said electrophotographic photosensitive member by using an exposing device of the electrophotographic apparatus;

a transferring device configured and positioned with respect to said electrophotographic photosensitive member to transfer the toner image onto a recording medium; and a fixing device configured and positioned with respect to the recording medium to fix the toner image on the recording medium, said charging device comprising a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising:

charged particles that come into contact with said electrophotographic photosensitive member; and a charged particle support configured and positioned to support the charged particles, the surface of said charged particle support being conductive and elastic, said charging device being configured and positioned with respect to said electrophotographic photosensitive member to support residual toner on the surface of said electrophotographic photosensitive member after the toner image formed on the surface of said electrophotographic photosensitive member by using said developing device is transferred onto the recording medium through said transferring device, said charging device also being configured and positioned with respect to said electrophotographic photosensitive member to normalize the electrical charge of the residual toner, said charging device further being configured and positioned with respect to said electrophotographic photosensitive member to return the normalized residual toner onto the surface of said electrophotographic photosensitive member, said developing device also being configured and positioned with respect to said electrophotographic photosensitive member and said charging device to recover the normalized residual toner returned onto the surface of said electrophotographic photosensitive member, wherein the absolute value of the charge potential difference between a first rotation and a second rotation of said electrophotographic photosensitive member is higher than 5 V and lower than 70 V, wherein said electrophotographic photosensitive member further comprises a charge injection layer at the surface thereof, wherein the surface of said electrophotographic photosensitive member is charged by direct injection of electrical charge from said contact charging member to said charge injection layer, wherein said charge injection layer comprises a binder resin and at least one of conductive particles and a charge transporting substance, wherein the binder resin comprises a curable resin, and wherein the curable resin is at least one resin selected from the group consisting of phenol resins, epoxy resins, and siloxane resins.

37. An electrophotographic apparatus including a toner recycling system, said apparatus comprising:

an electrophotographic photosensitive member comprising a support and a photosensitive layer on said support;

charging means for charging the surface of said electrophotographic photosensitive member;

exposing means for exposing the charged surface of said electrophotographic photosensitive member to form an electrostatic latent image;

developing means for developing the electrostatic latent image with toner so as to form a toner image;

transferring means for transferring the toner image onto a recording medium; and fixing means for fixing the toner image on the recording medium, said charging means comprising a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising:

charged particles that come into contact with said electrophotographic photosensitive member; and a charged particle support configured and positioned to support the charged particles, the surface of said charged particle support being conductive and elastic, said charging means also being means for supporting residual toner on the surface of said electrophotographic photosensitive member after transfer of the toner image by said transferring means, for normalizing the electrical charge of the normalized residual toner, and for returning the residual toner onto the surface of said electrophotographic photosensitive member, said developing means also being means for recovering the normalized residual toner returned onto the surface of said electrophotographic photosensitive member, wherein the absolute value of the charge potential difference between a first rotation and a second rotation of said electrophotographic photosensitive member is higher than 5 V and lower than 70 V, and wherein the charged particles comprises conductive particles having a grain diameter in the range of 10 nm to 10 $\mu$m, the resistivity of the charged particles being in the range of $10^{-1}$ Ω·cm to $10^{12}$ Ω·cm, and the amount of the charged particles supported on said charged particle support being in the range of 0.1 mg/cm$^2$ to 50 mg/cm$^2$.

38. A process cartridge which is detachably attachable to a main body of an electrophotographic apparatus, said process cartridge comprising:

an electrophotographic photosensitive member comprising a support and a photosensitive layer;

charging means for charging the surface of said electrophotographic photosensitive member;

developing means for developing an electrostatic latent image with toner so as to form a toner image, the electrostatic latent image being formed on the charged surface of said electrophotographic photosensitive member by using exposing means of the electrophotographic apparatus;

transferring means for transferring the toner image onto a recording medium; and fixing means for fixing the toner image on the recording medium, said charging means comprising a contact charging member that comes into contact with the surface of said electrophotographic photosensitive member, the surface of said electrophotographie photosensitive member being charged by direct injection of electrical charge from said contact charging member to said electrophotographic photosensitive member, said contact charging member comprising:

charged particles that come into contact with said electrophotographic photosensitive member; and a charged particle support configured and positioned to support the charged particles, the surface of said charged particle support being conductive and elastic, said charging means also being means for supporting residual toner on the surface of said electrophotographic photosensitive member after the toner image formed on the surface of said electrophotographic photosensitive member by using said developing means is transferred onto the recording medium through said transferring means, for normalizing the electrical charge of the residual toner, and for returning the residual toner onto the surface of said electrophotographic photosensitive member, said developing means also being means for recovering the normalized residual toner returned onto the surface of said electrophotographic photosensitive member, wherein the absolute value of the charge potential difference between a first rotation and a second rotation of said electrophotographic photosensitive member, is higher than 5 V and lower than 70 V, and wherein the charged particles comprise conductive particles having a grain diameter in the range of 10 nm to 10 $\mu$m, the resistivity of the charged particles being in the range of $10^{-1}$ Ω·cm to $10^{12}$ Ω·cm, the amount of the charged particles supported on said charged particle support being in the range 0.1 mg/cm$^2$ to 50 mg.cm$^2$.

39. An electrophotographic apparatus including a toner recycling system, said apparatus comprising:

an electrophotographic photosensitive member comprising a support and a photosensitive layer on the support;

a charger configured and positioned with respect to said electrophotographic photosensitive member to charge the surface of said electrophotographic photosensitive member;

an exposing device configured and positioned with respect to said electrophotographic photosensitive member to expose the charged surface of said electrophotographic photosensitive member to form an electrostatic latent image;

a developing device configured and positioned with respect to said electrophotographic photosensitive member to develop the electrostatic latent image with toner so as to form a toner image;

a transferring device configured and positioned with respect to said electrophotographic photosensitive member to transfer the toner image onto a recording medium; and a fixing device configured and positioned with respect to the recording medium to fix the toner image on the recording medium, wherein said charger comprises a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising:

charged particles that come into contact with said electrophotographic photosensitive member; and a charged particle support configured and positioned to support the charged particles, said surface of said charged particle support being conductive and elastic, said charger being configured and positioned to support residual toner on the surface of said electrophotographic photosensitive member after transfer of the toner image by said transferring device, said charger also being configured and positioned to normalize the electrical charge of the residual toner, said charging device further being configured and positioned to return the normalized residual toner onto the surface of said electrophotographic photosensitive member, said developing device being configured and positioned with respect to said electrophotographic photosensitive member and said charger to recover the normalized residual toner returned onto the surface of said electrophotographic photosensitive member, and wherein the absolute value of the charge potential difference between a first rotation and a second rotation of said electrophotographic photosensitive member in higher than 5 V and lower than 70 V, and wherein the charged particles comprise conductive particles having a grain diameter in the range of 10 nm to 10 $\mu$m, the resistivity of the charged particles being in the range of $10^{-1}$ Ω·cm to $10^{12}$ Ω·cm, and the amount of the charged particles supported on said charged particle support being in the range 0.1 mg/cm$^2$ to 50 mg.cm$^2$.

40. A process cartridge which is detachably attachable to a main body of an electrophotographic apparatus, said process cartridge comprising:

an electrophotographic photosensitive member comprising a support and a photosensitive layer;

a charging device configured and positioned with respect to said electrophotographic photosensitive member to charge said electrophotographic photosensitive member;

a developing device configured and positioned with respect to said electrophotographic photosensitive member to develop an electrostatic latent image with toner so as to form a toner image, the electrostatic latent image being formed on the charge surface of said electrophotographic photosensitive member by using an exposing device of the electrophotographic apparatus;

a transferring device configured and positioned with respect to said electrophotographic photosensitive member to transfer the toner image onto a recording medium; and a fixing device configured and positioned with respect to the recording medium to fix the toner image on the recording medium, said charging device comprising a contact charging member that comes into contact with the surface of said electrophotographic photosensitive member, the surface of said electrophotographic photosensitive member being charged by direct injection of electrical charge from said contact charging member to said electrophotographic photosensitive member, said contact charging member comprising:

charged particles that come into contact with said electrophotographic photosensitive member; and a charged particle support configured and positioned to support the charged particles, the surface of said charged particle support being conductive and elastic, said charging device being configured and positioned with respect to said electrophotographic photosensitive member to support residual toner on the surface of said electrophotographic photosensitive member after said toner image formed on the surface of said electrophotographic photosensitive member by using said developing device is transferred onto the recording medium through said transferring device, said charging device also being configured and positioned with respect to said electrophotographic photosensitive member to normalize the electrical charge of the residual toner, said charging device further being configured and positioned with respect to said electrophotographic photosensitive member to return the normalized residual toner onto the surface of said electrophotographic photosensitive member, said developing device also being configured and positioned with respect to said electrophotographic photosensitive member and said charging device to recover said normalized residual toner returned onto the surface of said electrophotographic photosensitive member, wherein the absolute value of the charge potential difference between a first rotation and a second rotation of said electrophotographic photosensitive member is higher than 5 V and lower than 70 V, and wherein the charged particles comprise conductive particles having a grain diameter in the range of 10 nm to 10 $\mu$m, the resistivity of the charged particles being in the range of $10^{-1}\Omega\cdot$cm to $10^{12}$ $\Omega\cdot$cm, and the amount of the charged particles supported on said charged particle support being in the range 0.1 mg/cm$^2$ to 50 mg.cm$^2$.

* * * * *

UNITED STATES PATENT AND TRADEMARK OFFICE

CERTIFICATE OF CORRECTION

PATENT NO. : 6,829,459 B2
DATED : December 7, 2004
INVENTOR(S) : Daisuke Tanaka et al.

It is certified that error appears in the above-identified patent and that said Letters Patent is hereby corrected as shown below:

Title page,
Item [56], References Cited, FOREIGN PATENT DOCUMENTS,
"JP 05297672 A 11/1993" should read -- JP 5-297672 A 11/1993 --.
"JP 11305521 A 11/1999" should read -- JP 11-305521 A 11/1999 --.
"JP 2000056543 A 2/2000" should read -- JP 2000-56543 A 2/2000 --.

Column 1,
Line 44, "blushes," should read -- brushes, --.

Column 3,
Line 16, "stored-in" should read -- stored in --.

Column 7,
Line 46, "FIG. 6" should read -- FIG. 6. --.

Column 15,
Line 12, "resistance" should read -- resistivity --.

Column 26,
Line 30, "were" should read -- was --.
Line 61, "was" should read -- were --.

Column 34,
Line 42, "electrophotographie" should read -- electrophotographic --.

Signed and Sealed this

Twenty-sixth Day of April, 2005

JON W. DUDAS
*Director of the United States Patent and Trademark Office*